United States Patent [19]

Pops

[11] 4,055,445

[45] Oct. 25, 1977

[54] METHOD FOR FABRICATION OF BRASS ALLOY

[75] Inventor: Horace Pops, Fort Wayne, Ind.

[73] Assignee: Essex International, Inc., Ft. Wayne, Ind.

[21] Appl. No.: 633,580

[22] Filed: Nov. 20, 1975

Related U.S. Application Data

[60] Continuation-in-part of Ser. No. 508,098, Sept. 20, 1974, Continuation of Ser. No. 107,118, Jan. 18, 1971, abandoned, Continuation of Ser. No. 580,804, May 27, 1975, Continuation of Ser. No. 311,218, Dec. 1, 1972, abandoned, Division of Ser. No. 107,118, Jan. 18, 1971, abandoned.

[51] Int. Cl.[2] ..... C22F 1/08

[52] U.S. Cl. ..... 148/11.5 C

[58] Field of Search ..... 148/11.5 R, 32, 11.5 C; 75/157.5

[56] References Cited

U.S. PATENT DOCUMENTS 3,783,037 1/1974 Brook et al. ..... 148/11.5 R

*Primary Examiner*—W. Stallard

*Attorney, Agent, or Firm*—Allegretti, Newitt, Witcoff & McAndrews

[57] ABSTRACT

An improved ternary brass alloy includes silicon as the additive material and may be fabricated to provide a beta brass or a mixed alpha plus beta brass material. The composition limits of the constituents of the beta brass are fixed by two factors: (1) the $M_s$ or Martensite transformation temperature must be determined, and (2) the brass must be a totally beta phase above 454° C. The composition is betatized, that is, heated at approximately 800° C. and quenched at a fast rate so that the total beta phase is retained in order to provide material having a shape memory effect, a low spring back coefficient and super elastic properties. A continuous betatizing and quenching process may be utilized in the manufacture of strip and sheet products. Alternatively, specific compositions may be cold worked to provide a material having a low spring back coefficient and other improved physical characteristics. The alpha plus beta brass includes 25% to 75% by weight beta phase mixed with alpha phase. The gamma phase is not tolerated. Generally, the same composition limits as the beta brass material are observed through processing and characteristics of the mixed alpha plus beta are distinct. Methods for manufacture of the mixed alpha plus beta phase are disclosed.

6 Claims, 26 Drawing Figures

(α+β x40

CuZnSi (β-PHASE x40

ENGINEERING STRESS VS. STRAIN CURVE FOR TYPICAL COMMERCIAL MATERIAL

EFFECT OF COLD-ROLLING ON YIELD STRENGTH
0.1% OFFSET

EFFECT OF COLD-ROLLING ON ULTIMATE STRENGTH

FIG. 17.
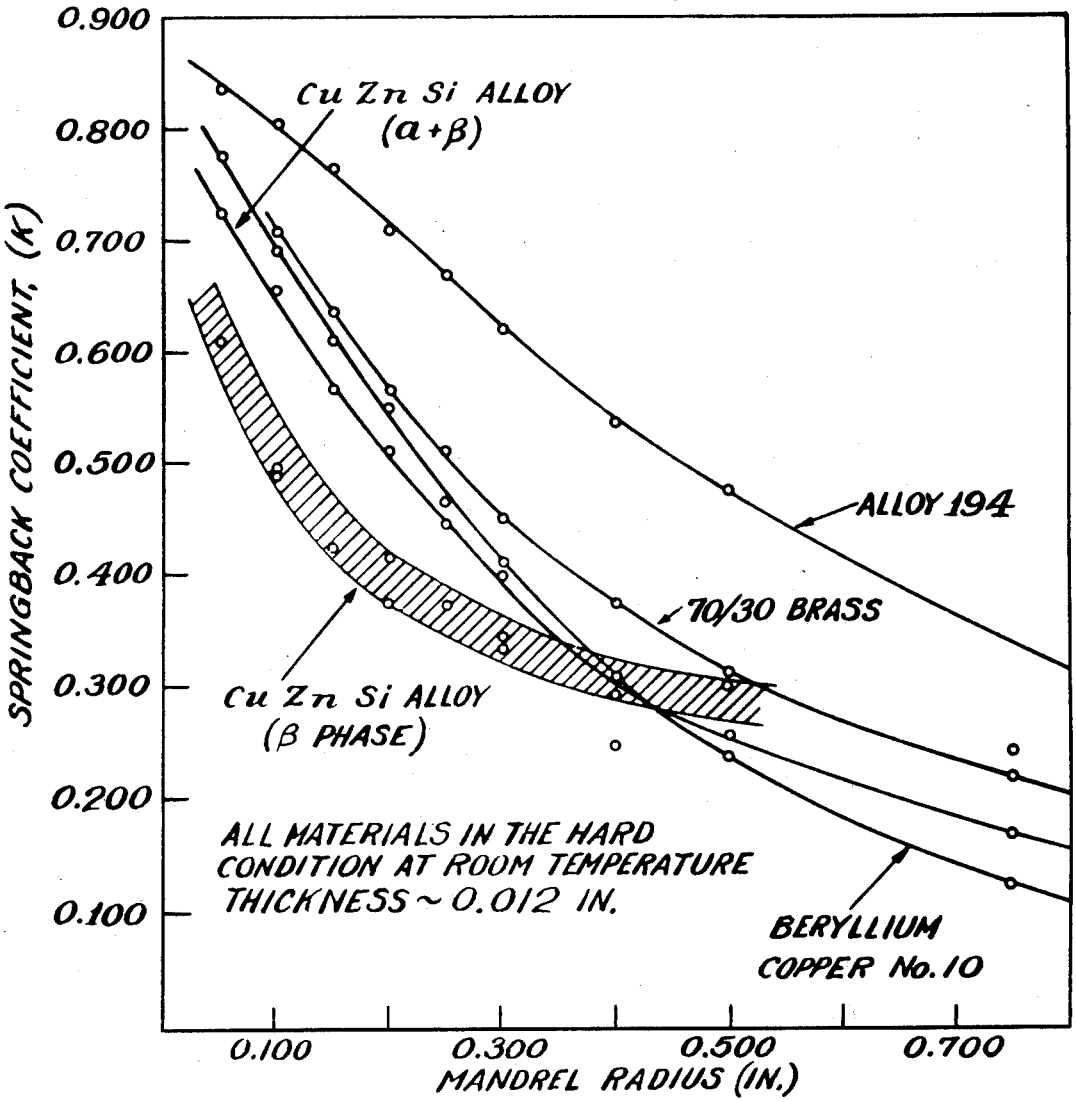
SPRINGBACK COEF. (K) $K = \frac{a_F}{a_0} = \frac{R_0 + h/2}{R_F + h/2} = 0 \text{ to } 1$
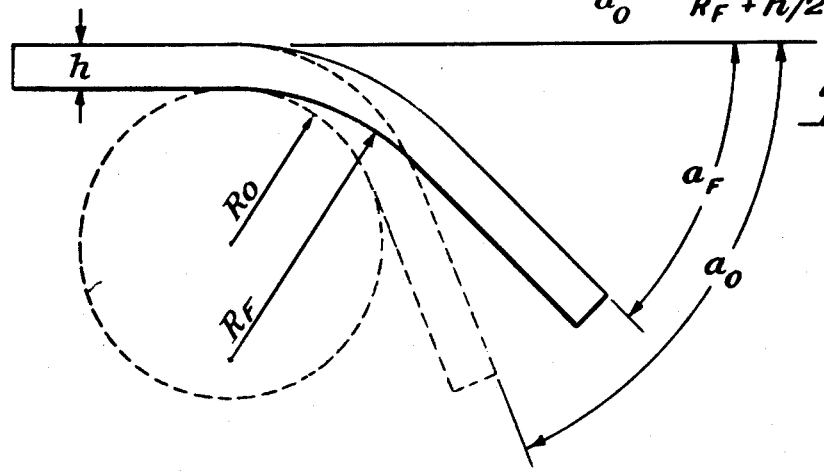
FIG. 16.

METHOD IV

METHOD VI 0.2 % OFFSET YIELD STRENGTH →
60
50
40
30
20
10
0
0
10
20
30
40
% BETA PHASE →

TENSILE STRENGTH, KSI →
120
100
80
60
40
20
0
10
20
30
40
WEIGHT % ZINC →
ALLOY OF INVENTION
CU-ZN ALLOYS

METHOD FOR FABRICATION OF BRASS ALLOY

CROSS REFERENCE TO RELATED APPLICATIONS

This is a continuation-in-part of application Ser. No. 508,098 filed Sept. 20, 1974, a continuation of application Ser. No. 107,118 filed Jan. 18, 1971, now abandoned; and application Ser. No. 580,804 filed May 27, 1975, a continuation of Ser. No. 311,218, filed Dec. 1, 1972, now abandoned, a division of Ser. No. 107,118 filed Jan. 18, 1971, now abandoned.

BACKGROUND OF THE INVENTION

This invention relates to two improved brass alloys and their fabrication process, and in particular to a ternary silicon brass alloy which is fabricated into strip, sheet, or wire. One of the new alloys, a beta brass alloy, has a low spring back coefficient and a shape memory effect.

Utilization of various report elements in a brass (copper-zinc) system has been suggested heretofore for the purpose of obtaining certain desired characteristics in the system. Edmunds in U.S. Pat. No. 2,394,673, for example, suggested the addition of 1.2% silicon to a 70/30 cartridge brass to provide resistance to season cracking. The present inventor has investigated numerous ternary beta brass alloys and has reported his findings in the *Transactions of the Metallurgical Society of AIME,* Volume 230 (1964), Page 267; Volume 230, Page 1662 (1964); Volume 236, Page 1532 (1966); Volume 239, Page 756; Volume 239, Page 1668 (1967); and *Metallurgical Transactions,* Volume 1, Page 251 (1970).

These cited references reported studies relating to the Martensitic transformations of various ternary brass alloys. A determination was made of the Martensitic transformation temperature as a function of the percentage of the third element content in such alloys. In addition, an investigation of the reaction of such alloys to stresses and temperature changes were reported in these various publications. These publications thus serve as a part of the background to the invention for the beta brass alloy.

Additional background information relates to the formability of multiphase copper based alloys (such as Muntz Metal, 60 Cu - 40 Zn). Such alloys are not usually cold formed. In fact, the Metals Handbook reports that some compositions are impossible to cold work enough to produce spring temper, a reduction in thickness of 60%. Since these two-phase materials have poor cold forming and drawing properties compared with single phase alloys, the castings are usually broken down by hot-working. To overcome such difficulties and processing requirements, the described alpha plus beta brass alloy and process was developed.

SUMMARY OF THE INVENTION

In a principal aspect then, one embodiment of the present invention comprises an improved beta phase brass alloy and an improved method for manufacture of the alloy. The beta brass alloy has a low spring back coefficient and consists essentially of 0.25% to 3.00% by weight silicon (0.56 to 6.6 atomic %), 25.00% to 40.00% by weight zinc (23.5 to 40.5 atomic %) and the balance copper. The composition requires a stable beta phase above 454° C. and has a Martensitic transformation temperature defined by the formula $M_s \approx 3280°$ K-80Zn°K-120Si°K.

The improved alpha plus beta phase brass alloy requires a mix of alpha and beta phase silicon brass with no gamma phase and a minimum of 25% beta phase in the range 400°-550° C. Annealing at 400° C. to 550° C. is alternated with cold rolling steps in the method of manufacture associated with the alpha plus beta brass alloy.

It is a further object of the present invention to provide an improved beta brass alloy which exhibits a shape memory effect.

A further object of the present invention is to provide an improved alpha plus beta brass alloy which is easily fabricated, particularly in the strip, sheet and wire forms. Such an alloy may thus be utilized for the manufacture of springs, particularly for electrical applications.

A further object of the present invention is to provide an alpha plus beta brass alloy which exhibits a low spring back coefficient when that alloy is treated by means of appropriate commercial cold working and hot working processes. It is a particular advantage of such a composition that the material may be fabricated into a desired shape by means of presently available commercial fabrication operations. At the same time, the material maintains a low spring back coefficient, that is, a spring back coefficient which is lower than the coefficient of competitive materials presently available for commercial application, e.g. beryllium copper, hosphour bronze, cartridge brass and Alloy 194.

Still a further object of the present invention is to provide a process for continuously betatizing and quenching materials, particularly strip and sheet to form a beta brass alloy.

Another object is to provide processes for manufacture and fabrication of the disclosed products.

These and other objects, advantages and features of the invention will be set forth in the detailed description which follows.

BRIEF DESCRIPTION OF THE DRAWINGS

In a detailed description which follows, reference will be made to the drawings comprised of the following FIGURES:

FIG. 16 is a schematic illustration used to illustrate the definition of the spring back coefficient;

FIG. 17 is a graphical representation of spring back coefficient for silicon brass as compared to several prior art materials;

DESCRIPTION OF THE PREFERRED EMBODIMENT

The unique properties which are the result of the beta brass alloy of the invention requires not only a specific composition of materials but also a unique combination of steps. The alpha plus beta brass alloy is also fabricated and worked according to a unique combination of steps. Thus, first there will be discussed the requirements for the composition. This will be followed by a discussion of the process used once the composition has been made. Following this, specific examples will be set forth and then a discussion of the numerous advantages and properties of the invention will be provided. Note that certain embodiments of the silicon brass alloy and methods I, II and III were disclosed in prior and copending applications referenced above and incorporated herewith by reference. Copper, zinc and silicon are the materials utilized in the appropriate amounts and fabricated by the appropriate process to provide both the beta brass as well as the alpha plus beta brass alloy of the invention.

COMPOSITION — BETA BRASS ALLOY

Figure 1:
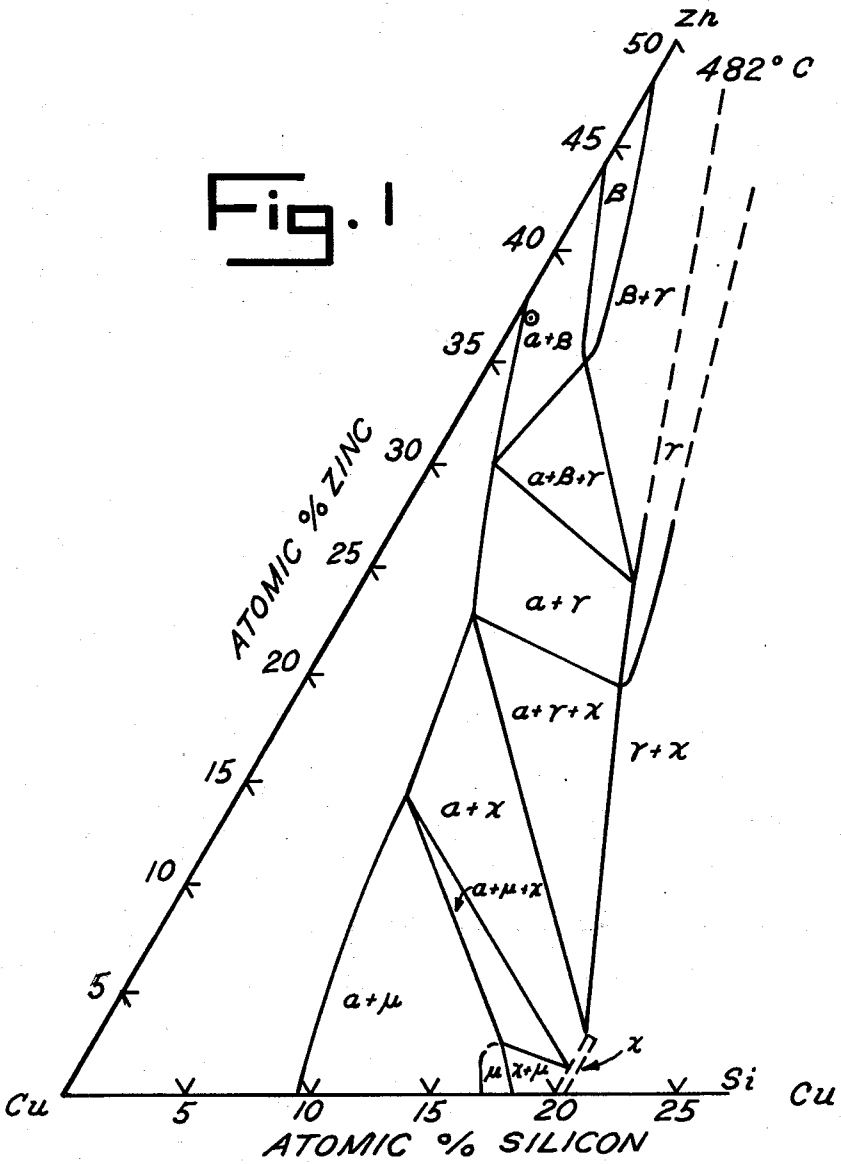
FIG. 1 is a portion of the isothermal section at 482° C. of the copper silicon zinc ternary phase diagram.
Figure 2:
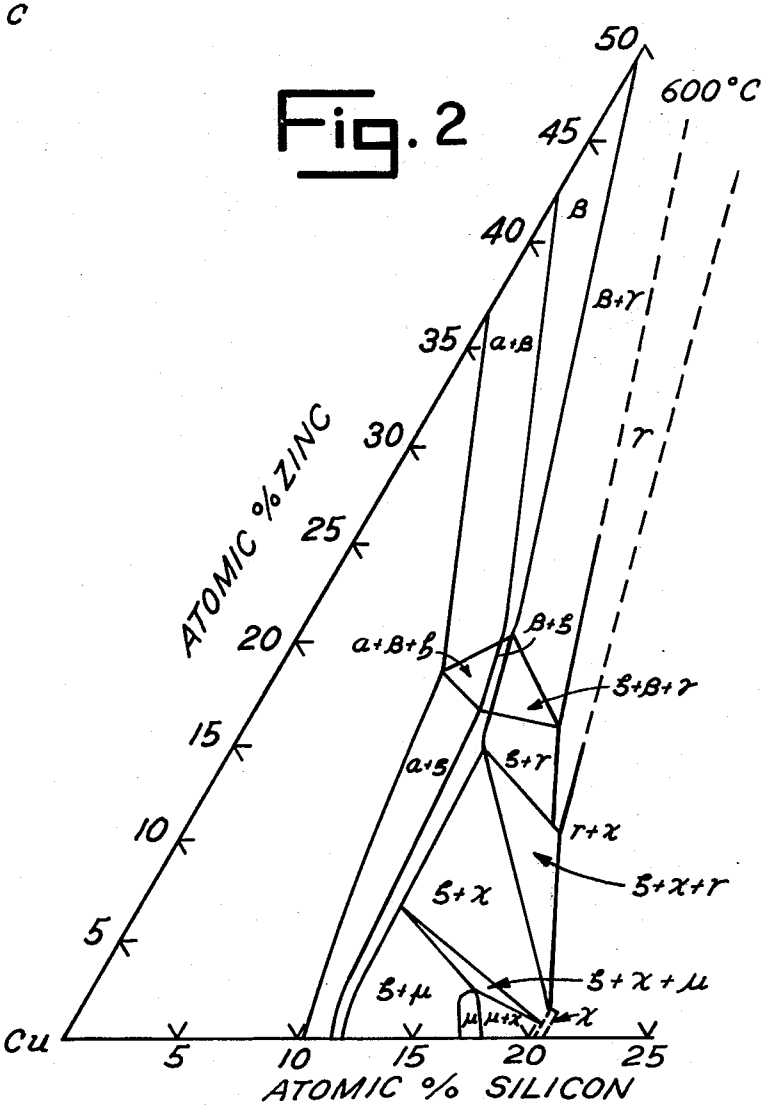
FIG. 2 is a portion of the isothermal section at 600° C. of the copper silicon zinc ternary phase diagram.
Figure 4:
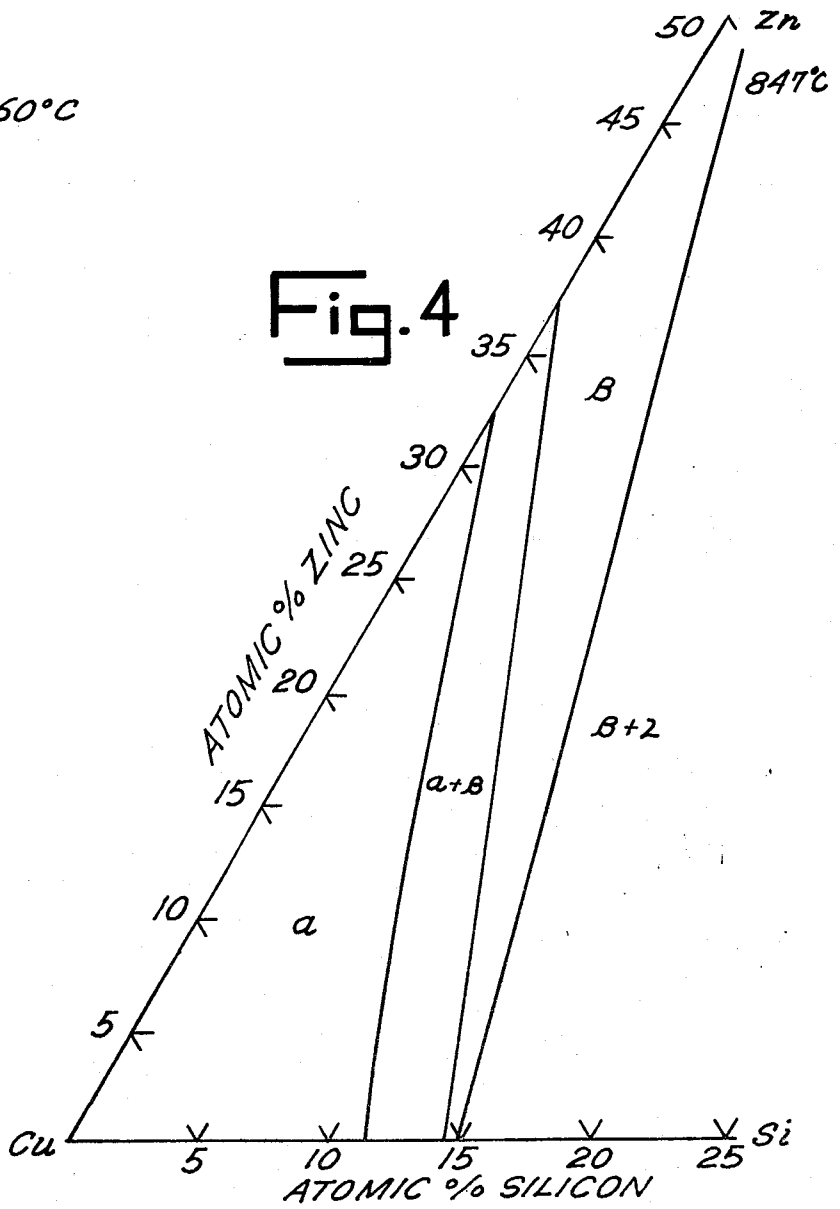
FIG. 4 is a portion of the isothermal section at 847° C. of the copper silicon zinc ternary phase diagram.
Figure 3:
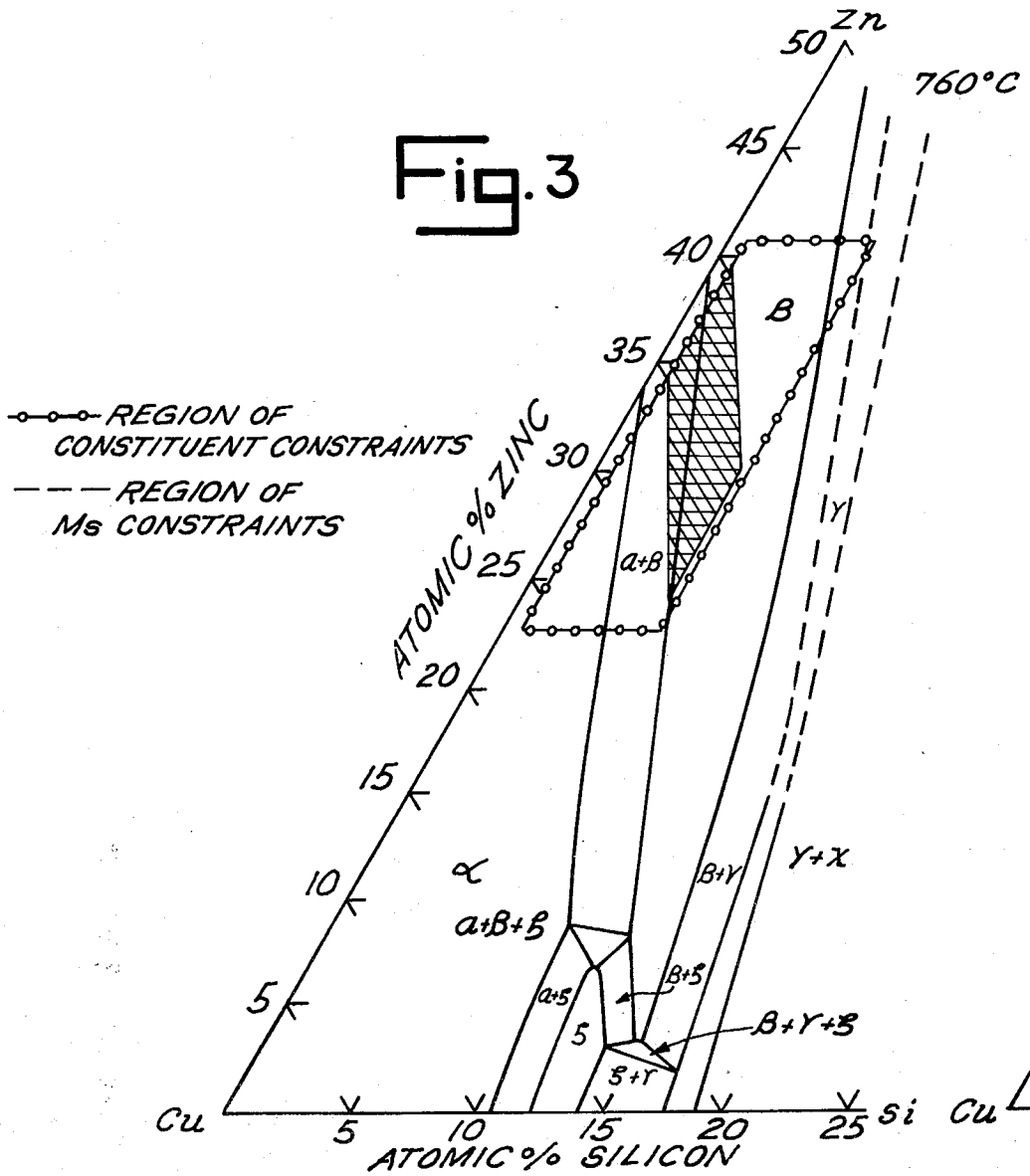
FIG. 3 is a portion of the isothermal section at 760° C. of the copper silicon zinc ternary phase diagram.

For the beta brass alloy, the composition must provide a beta phase material above 454° C. FIGS. 1 through 4 illustrate four isothermal sections of the ternary phase diagram for the copper-silicon-zinc system. As can be seen by an examination of the ternary phase diagrams, the existence of the beta phase (which is a body-centered cubic phase) is, in part, dependent upon the temperature. That is, whether or not a beta phase can exist at a particular composition depends upon the temperature of the system. For example, much of the experimentation which will be described below relates to a composition which includes 36.5 atomic percent zinc and 1.0 atomic percent silicon. At 847° C. such a composition is in the beta phase as illustrated in FIG. 4. At 760° C., however, as illustrated in FIG. 3, the material is comprised of the alpha plus beta phases. One may provide a composition that will, however, have a beta phase at the desired temperature by choosing amounts of constituents as determined by the isothermal diagrams of FIGS. 1 through 4. To recapitulate, the first important consideration, then, in the manufacture of the beta brass materials is that the material can be maintained entirely in the beta phase at a desired temperature above 454° C.

The second important criterion relating to the beta brass composition is determined by the Martensitic transformation temperature. Experimental results reported in the above-noted background literature have shown that the following formulation is qualitatively determinative of the Martensitic transformation temperature of a copper-silicon-zinc alloy:

$M_s$(°K) $\approx$ 3280-80Zn-120Si where Zn = atomic percent Zinc and Si = atomic percent silicon.

As will be described below, it has been found desirable to maintain the Martensitic tranformation temperature of the beta brass alloy of the invention at approximately the same temperature or slightly below the temperature at which the material being fabricated will be used. Most often, this will be room temperature. Thus, the beta brass composition is chosen by examination of two separate criteria:

1. The composition must provide a continuous beta phase material at a temperature above 454° C. Preferably, the material is a beta phase material when heated above 600° C.

2. The Martensitic transformation temperature of the material is at or below the temperature at which the alloy is intended to be used.

As a result of these two criteria, it has been found that the brass alloy which includes 25.00% to 40.00% by weight zinc (23.5 to 40.5 atomic %) and 0.25% to 3.00% by weight silicon (0.56 to 6.6 atomic %) with the remainder of the alloy being copper will provide the substantial limits of composition which can be processed within the scope of the invention. It should also be noted, however, that some impurities (fillers) may be included in the alloy composition up to an amount of approximately 5% appreciably without affecting the phenomena associated with the invention.

However, the criteria that the composition have a continuous beta phase and an appropriate $M_s$ temperature are still effective. The general limits of such composition are indicated in FIG. 3 by the cross hatched portion in the phae region. The optimum composition in weight percent was found to be 37.4 ± 1% Zn; 0.44 Si and the balance Cu (36.5 ± 1% Zn; 1.00% Si and balance copper in atomic percent).

COMPOSITION — ALPHA PLUS BETA ALLOY

Insofar as the $\alpha + \beta$ modification of the alloy is concerned, a first important consideration is that the microstructure contains both the $\alpha$ and $\beta$ phases. A second important criterion related to composition is that no $\gamma$ phase can be tolerated. A third requirement is that the amount of beta phase be made to underto a maximum and a minimum value, depending upon the choice of temperature, i.e., 25% to 75% by weight beta phase (see FIG. 20). It has also been found that zinc content exceeding about 40 by weight % reduces fabricability. In general, the composition limits for the alpha plus beta phase material have been determined to be substantially the same as those established for the beta brass alloy and illustrated by the cross hatched portion of FIG. 3. The optimum composition is also the same as that of the beta brass alloy.

PROCESS

Figure 5:
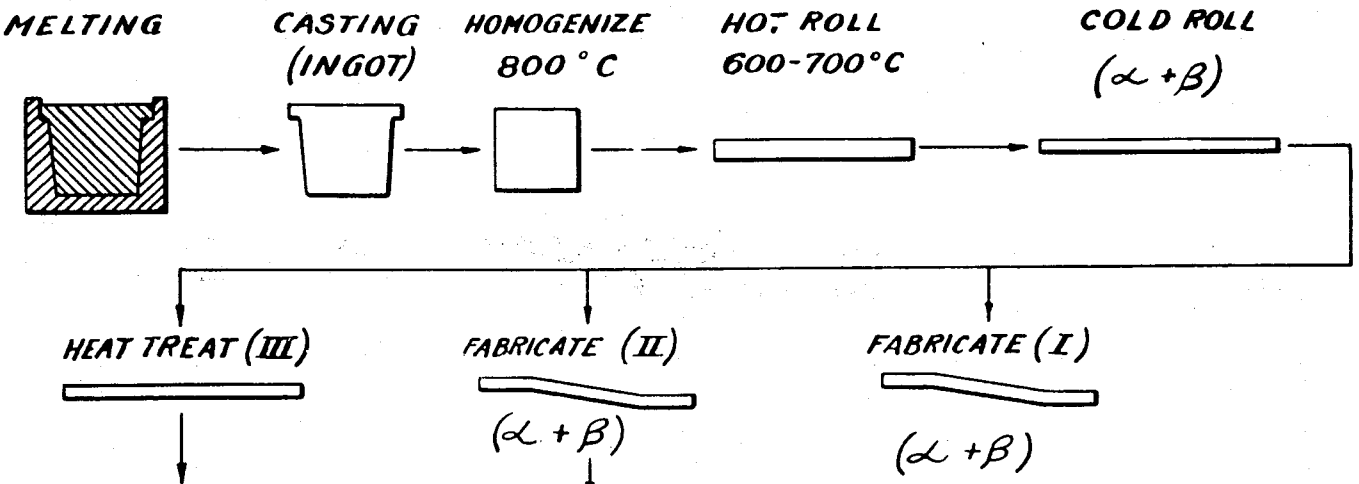
FIG. 5 is a schematic representation of a typical fabrication schedule illustrating three methods (Methods I, II and III) by which the silicon brass alloy is manufactured.

FIG. 5 illustrates schematically a fabrication flow chart which outlines various processes by which a silicon-brass alloy may be fabricated to provide the unusual and desired characteristics described in detail below. There are generally three processes set forth in the above reference application (Methods I, II and III) by which a silicon-brass alloy may be obtained. Two of these processes call for "betatization" or "betatizing" the composition.

Betatizing or betatization is a word utilized to describe a distinct step in the process of the present invention. Betatizing or betatization can be defined as the heating or annealing process by which the composition is maintained at an appropriate temperature above 454° C. until all of the composition is changed into the beta phase. The term is analogous to austentization which is well known for steels. As with austentization in steel, a time temperature transformation (TTT) diagram can be provided for the alloy of the present invention. In the specific examples below, it can be seen that time temperature transformation relationships for the specific examples are indicated.

As shown in FIG. 5, the first step for each of the schematically illustrated three processes calls for combining the constituents of the alloy, melting them together and casting them into an ingot. The casting may then be homogenized at approximately 800° C. Homogenization can take place at a lower temperature, for example, 700° C. when the alloy may be in the $\alpha + \beta$ phase. Next, the casting may be hot rolled at between 600° to 800° C. The amount of reduction by hot rolling is as desired. Cold rolling then follows with optional intermediate anneals at 525° C., for example, for a period of one-half hour. The annealing operation serves to recrystalize the alloy and thus other annealing temperatures are suitable, for example, any temperature in the range of 300° to 700° C. It is possible to cold roll and reduce the thickness of the sheet by as much as 70% to 95% without loss to the integrity of the material and without intermediate anneals.

It is now possible to merely fabricate the material into a desired sheet or rod product. This is illustrated by the symbology in FIG. 5 designated by Method I. The material in this case is composed of the apha (face-centered cubic) and beta phases. In Method I, it is important to note that the cold rolling operation follows a hot rolling opertion. Note Method I results in the manufacture of the alpha plus beta brass alloy which is discussed in greater detail below.

The processes illustrated by Methods II and III relates more particularly to the beta brass alloy. In each instance (Method II and Method III) the specific heat treatment utilized to create the desired material is the same. However, in Method II, the material is first fabricated into a desired shape, for example, a leaf spring, before heat treating. In Method III, the heat treatment is initially provided and then the material is fabricated into its ultimate desired product shape.

Returning then to the material of Method II, the material is initially in the alpha plus beta phase since it is derived as described for Method I. This material is fabricated into the desired shape and then betatized. Typically, the betatization must take place at more than 790° C. However, betatization does depend upon the composition of the material and the appropriate temperature may be determined by examination of the ternary phase diagram. Following betatization, the material is rapidly quenched at a rate preferably greater than 500° C. per second. The rapid quenching is necessary in order to retain the beta phase.

The process represented by Method III calls for betatization followed by rapid quenching as described for Method II. This in turn is followed by fabrication of the ultimte desired product, e.g. a spring. It has been found, in fact, that fabrication following betatization and quenching (Method III) enhances the properties of the material.

Figure 6:
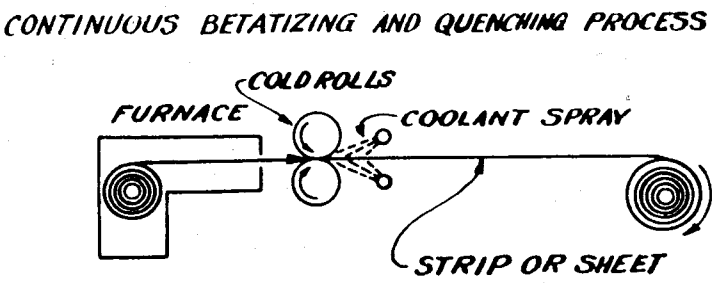
FIG. 6 is a schematic representation of means for providing a betatizing and quenching operation.

FIG. 6 illustrates a means for the continuous betatization heat treatment and the rapid quenching required in the association with the betatization process of strip or sheet. The material is initially rolled into strip or sheet form and heated to its proper betatization temperature in a furnace. The material is then unrolled or discharged from the furnace and immediately quenched by cold rolls and a coolant spray. This quench must be fast enough to prevent decomposition of the beta phase into any other phase. The beta phase is retained. The heat treated metal is then wound on a roll as indicated in FIG. 6.

Typically, using the arrangement of FIG. 6, the betatizing treatment for strip or sheet on an economical continuous basis (high processing rate is feasible) is achieved by providing slight tension (normal practice in strip or sheet finishing), and the proper roll pressure on the hot material as it passes through the heat extraction means (cold rolls and coolant spray). The roll pressure is adjusted to provide efficient heat transfer from the strip or sheet surfaces to the roll surfaces. The speed of the rolls, the coolant temperature and flow rate, and the takeup tension are then adjusted to provide the rapid quench or more than 500° C. per second to prevent decomposition of the beta phase and to yield flat, high quality strip or sheet.

EXAMPLES

EXAMPLE 1

A high purity of commercial copper in the amount of 62.19 weight percent (62.5 atomic percent) is combined with 37.37 weight percent (36.5 atomic percent) similar grade zinc and 0.44 plus or minus 0.10 weight percent silicon (1.0 atomic percent silicon). The constituents are thoroughly combined in a crucible, melted together and cast as an ingot. The resulting casting is then homogenized at approximately 800° C. The homogenized ingot is hot rolled at a temperature between 600° and 700° C. and reduced to a suitable plate thickness. Following this, the material is cold rolled up to 80% reduction. As an aside, it should be noted that intermediate anneals at 525° for one-half hour may be provided. However, it is important that the final operation in the process be a cold rolling operation. Such cold rolling enhances the desired physical properties of the material which has been fabricated. This material may then be fabricated into aa leaf spring, for example, the properties of which will be described in detail below. Note this material is a mixed alpha plus beta phase material.

EXAMPLE 2

The identical procedure to that set forth in Example 1 above is followed. However, subsequent to the cold rolling operation, the material is heat treated for 1 minute at 830° C. The material is then quenched at a rate greater than 500° per second and fabricated as desired. Alternatively, the material is fabricated and then heat treated at 830° C. and quenched at more than 500° C. per second as described. In each instance, the fabricated product may be leaf spring of the type, for example, described in Example 1.

EXAMPLE 3 i. Preparation of Cast Material

A 10,000 lb. heat of the alloy was prepared by a horizontal continuous casting process. Metal is drawn from the holding furnace into a graphite die, which is fitted in a cooling jacket. Molten metal solidifies within the die, and is drawn out as a ½ inch × 14 inches slab by the drawing unit. The drawing process takes place by steps with a pause after each step. Steps and pauses are so small that it appears to be drawn almost continuously.

Figure 18:
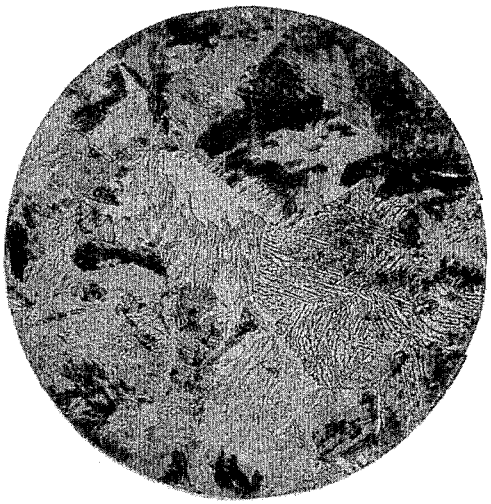
FIG. 18 is a photomicrograph of the as-cast structure of the silicon brass alloy taken at 40 magnifications from a section of continuously cast ½ inch slab.
Figure 19:
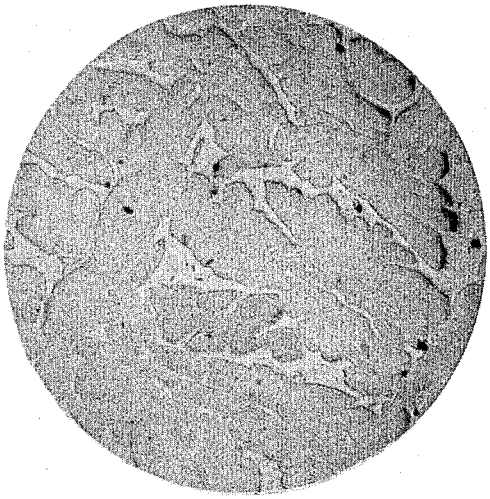
FIG. 19 is a photomicrograph of the as-cast structure of the silicon brass alloy taken at 40 magnifications from a section of a 4 inch × 4 inch ingot.

Melting temperature, strand temperature, cooling water circulation, draw movement, and draw speeds are varied by trial and error until a sound ingot is produced. A number of advantages have been achieved by this method of casting. First, the rapid cooling minimizes segregation, thereby eliminating the necessity for homogenization. Second, the small opening (½ inch) of the die, coupled with rapid heat extraction, produces a very fine as-cast microstructure, as shown in FIG. 18 and FIG. 19.

Particles of the $\alpha$ and $\beta$ phase, which are rods approximately 0.1 mm long by 0.01 mm in cross-section are disbursed uniformly throughout the casting. Heavy reduction of the slab is possible since there are no large isolated globules of the $\beta$ phase. Finally, the high fluidity of the molten metal allows the die to be filled easily, thereby reducing the tendency for formation of edge cracks. Consequently, the amount of metal loss is minimized with a nominal composition, in wt. %, of 62.2 Cu; 37.4 Zn; 0.4 Si.

ii. Preparation of Strip

Method IV

The cast material is then prepared in strip form. The as-cast slab is reduced about 50% in thickness. Although the preferred range for the initial breakdown is 30 to 60%, successful heavier reductions have been accomplished. Temperature range for intermediate annealing should be 400° C. to 550° C. in order to achieve the following two conditions:

a. softening, to condition the strip for subsequent cold rolling, and importantly, b. production of a continuous matrix of the softer $\alpha$ phase, in which the $\beta$ is distributed uniformly as the minor constituent.

Figure 20:
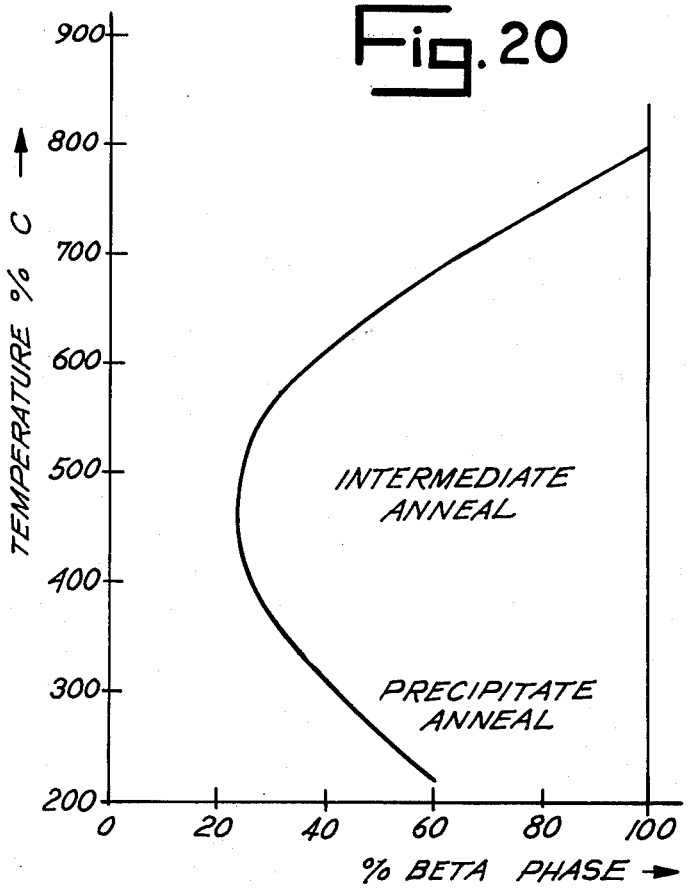
FIG. 20 is a graph of the variation with temperature of volume fraction of beta phase for the alloy.

As may be seen from FIG. 20, heating to this temperature range produces the maximum amount of the $\alpha$ phase, about 75%, a minimizes the amount of $\beta$, about 25%. The annealed material is then cooled for working. The $\beta$ phase is uniformly dispersed through the $\alpha$ phase during working. The large amount of $\alpha$ phase material facilitates working. Thus, this microstructure permits further cold reduction exceeding 95%. In general, however, the second reduction in thickness is about 65%.

Figure 21:
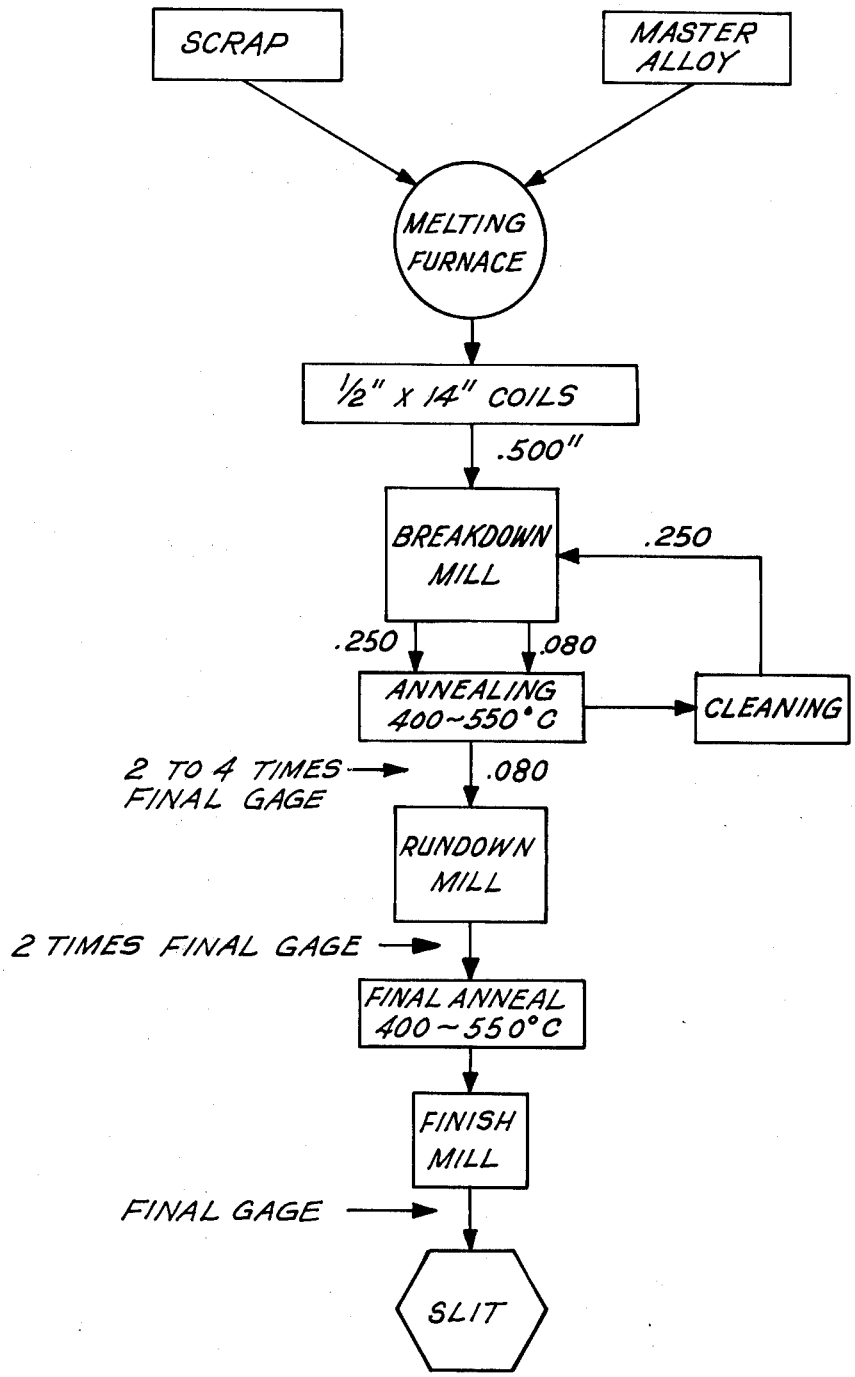
FIG. 21 is a flow chart illustrating a method (Method IV) for processing the alloy into strip.

Further annealing, cooling and working or reductions are effected to achieve a final product. FIG. 20 indicates the percentage of $\alpha$ and $\beta$ phase resulting after an anneal. The final product desirably includes up to 75% $\beta$ phase. The total number of breakdown steps and intermediate anneals depend, of course, upon the required final temper, thickness, and properties. A typical schedule to produce wrought strip is shown schematically in FIG. 21.

Method V

Figure 22:
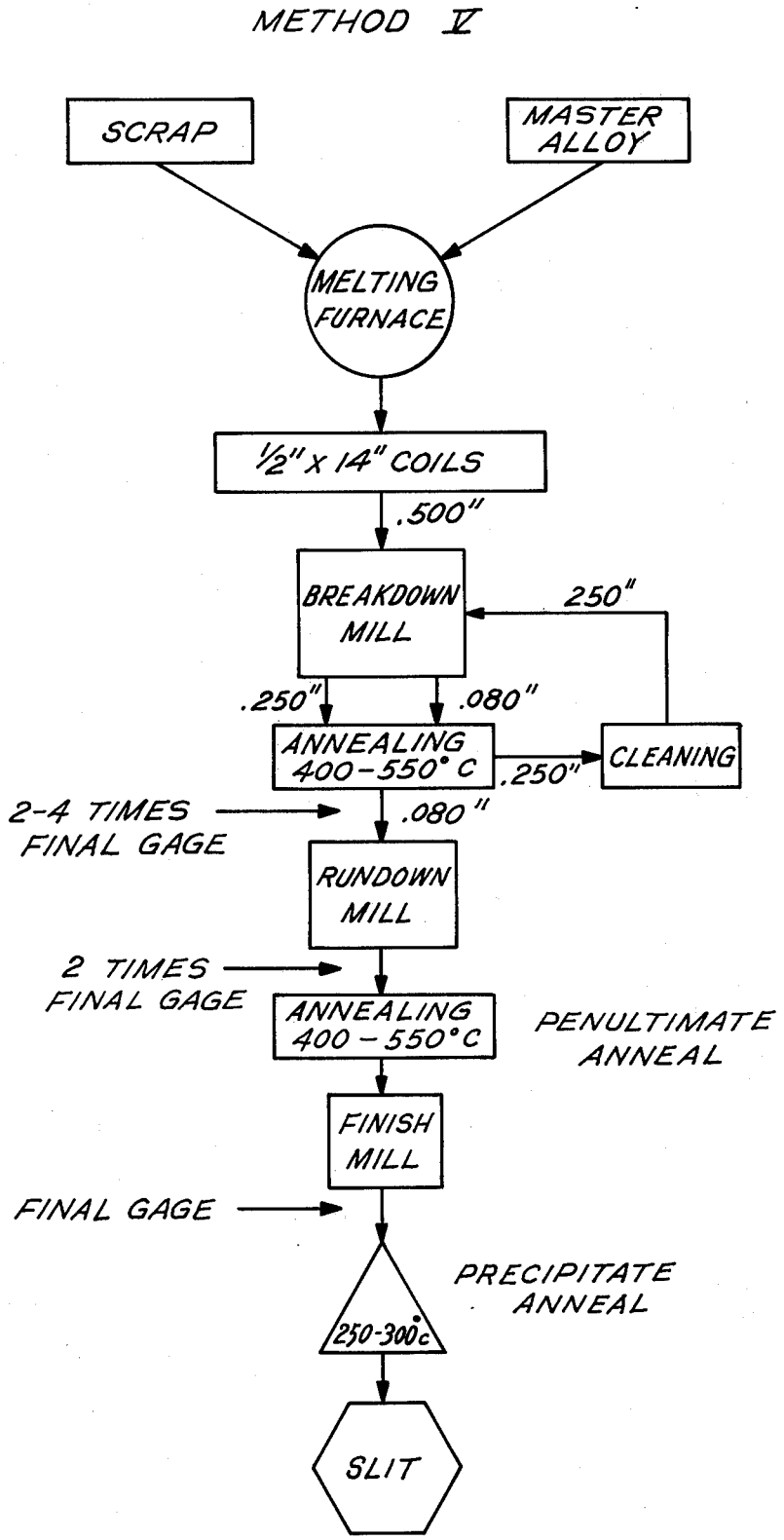
FIG. 22 is a flow chart illustrating the processing schedule including a low temperature anneal (Method V)

A modified processing schedule has been developed to further improve the properties of the final product. As shown in FIG. 22, Method IV is employed with the exception of a final low temperature partial anneal in the temperature range 250° C, to 300° C. for a period of time ranging between 4 and 9 hours. The purpose of this heat treatment is fourfold. First, the amount of $\beta$ phase is increased from 25% to about 50% at the expense of the $\alpha$ phase (see FIG. 20). Second, the grain size of the $\alpha$ matrix is made very fine, i.e., ~ 2 microns. Third, the $\beta$ phase is precipitated as extremely fine spheroidal particles, 1 micron producing a dispersion hardening effect. Fourth, residual deformation is reduced to a level of about 85% recrystallization. It will be shown later that this low temperature annealing process improves the fatigue properties, tensile strength, and ductility of the alloy.

Method VI

Figure 23:
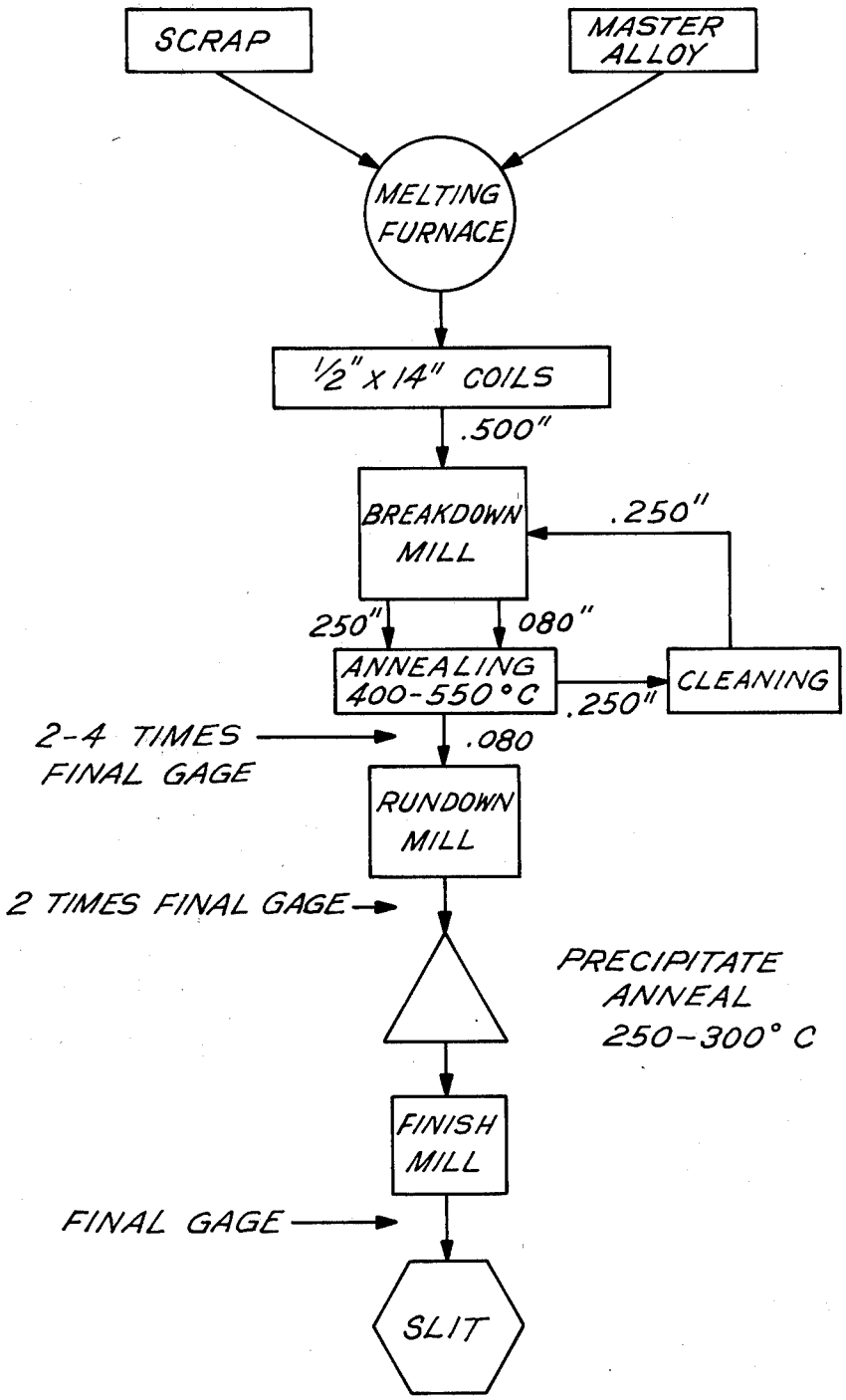
FIG. 23 is a flow chart illustrating the preferred processing schedule for producing the new alloy in strip form (Method VI)

FIG. 23 illustrates diagrammatically a third improved method of processing, which in fact, is the preferred method since it develops the best combination of properties in the alpha plus beta brass alloy. Standard casting, rolling and annealing steps of Method IV are employed until the penultimate annealing step.

The alloy is then almost fully annealed for times ranging between 4 and 24 hours in the temperature range 250° C. to 300° C. As in Method V, this produces a high volume fraction of $\beta$ (~ 50%), and a fine grain structure (1 to 2 microns), but in addition, most residual deformation is eliminated. The final step involves cold rolling the strip between approximately 10% and 50% reduction in thickness, depending upon the required final properties.

Properties

FIGS. 9 through 17 illustrate the properties observed in the alloys described in the Examples 1 and 2 as compared to the properties observed in typical prior art materials utilized for substantially the same purposes.

Figure 9:
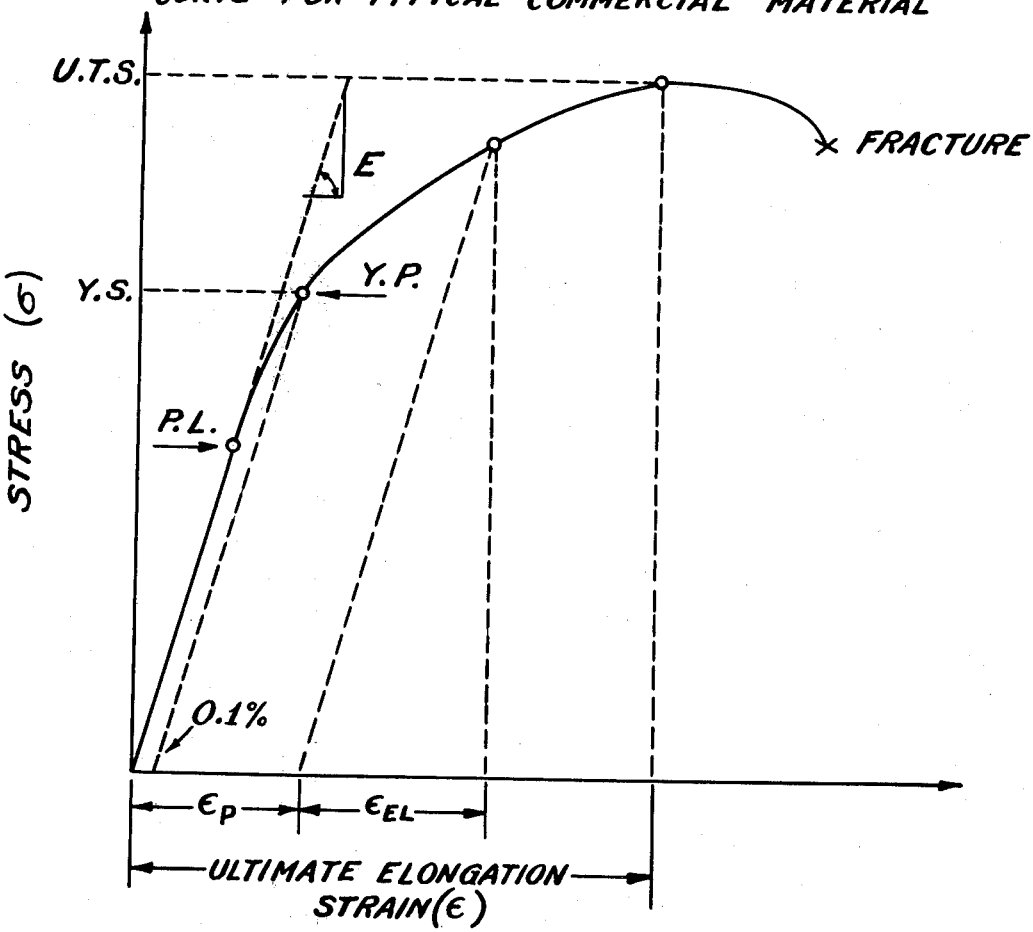
FIG. 9 is a typical engineering stress versus strain curve.

Referring first to FIG. 9, there is shown a typical engineering stress versus strain curve for a commercial material. The stress ($\delta$) is on the ordinate and strain ($\epsilon$) is on the abcissa. The letters "P.L" indicate the proportional limit, that is, the point on the stress-strain curve at which stress is no longer linearly proportional with strain. The yield point is that point where the strain is offset from the linear portion of the stress-strain curve by an amount equal to 0.1%. The stress at this point is defined as the yield stress, "Y.S.". The ultimate tensile stress, "U.T.S.", is the maximum stress which the material may be subjected to prior to fracture and is correlated with the ultimate elongation.

Figure 10:
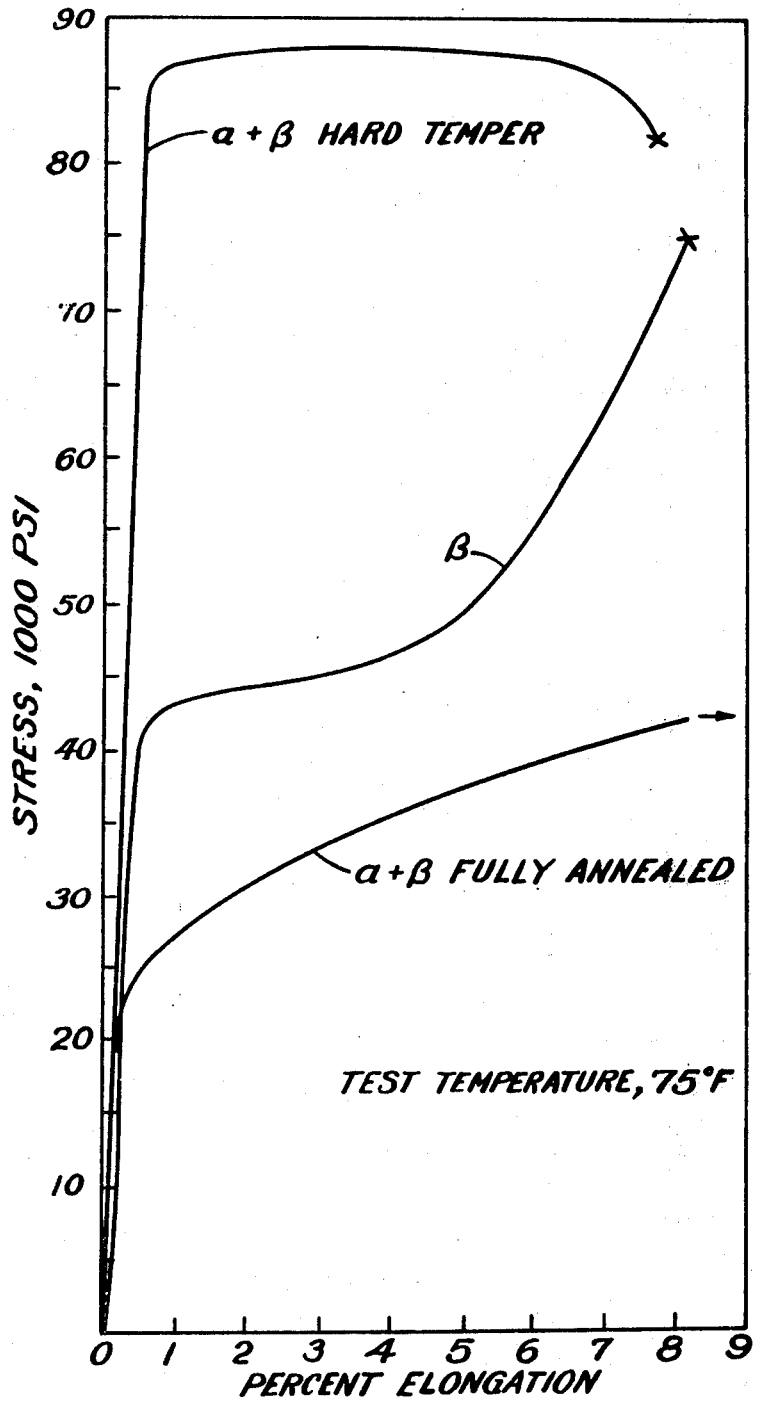
FIG. 10 is a stresss versus strain curve for two samples of silicon brass material.

Utilizing these definitions, FIG. 10 shows a typical stress-strain curve for the improved materials of the present invention. As indicated on FIG. 10, the material identified as alpha plus beta ($\alpha,\beta$) was fabricated as set forth in Example 1 above. The material tested for FIG. 10 was cold rolled with a 60% reduction in thickness. The material indicated by beta ($\beta$) was betatized and quenched as set forth in Example 2 using the process schematically described in FIG. 6.

Figure 11:
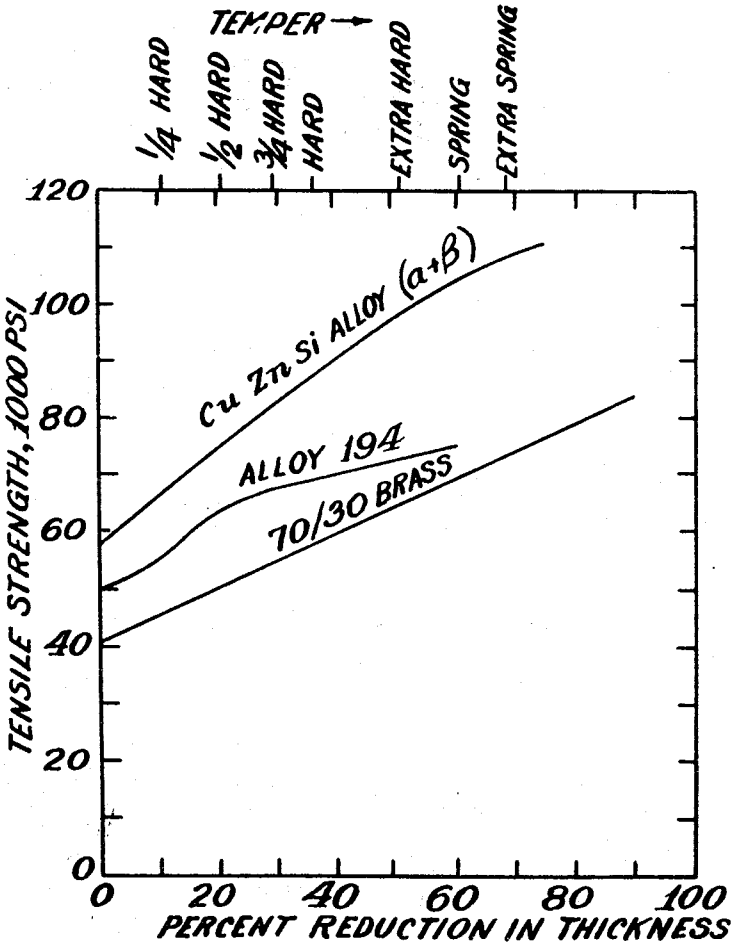
FIG. 11 is a graph representing a typical silicon brass alloy in comparison with other prior art material and plots the effect of cold rolling on the ultimate strength of said materials.

FIG. 11 illustrates the effect of increased reduction in thickness during cold rolling on the ultimate tensile strength (U.T.S.) for material of the type set forth in Example 1 above as compared with such prior art materials as 70/30 brass and 98% copper, 2% iron, 0.02% phosphorous, an alloy commonly used for electrical applications and spring applications and known as Alloy 194. Note the increase in the ultimate tensile strength of the silicon brass compared with the 70/30 alloy.

Figure 12:
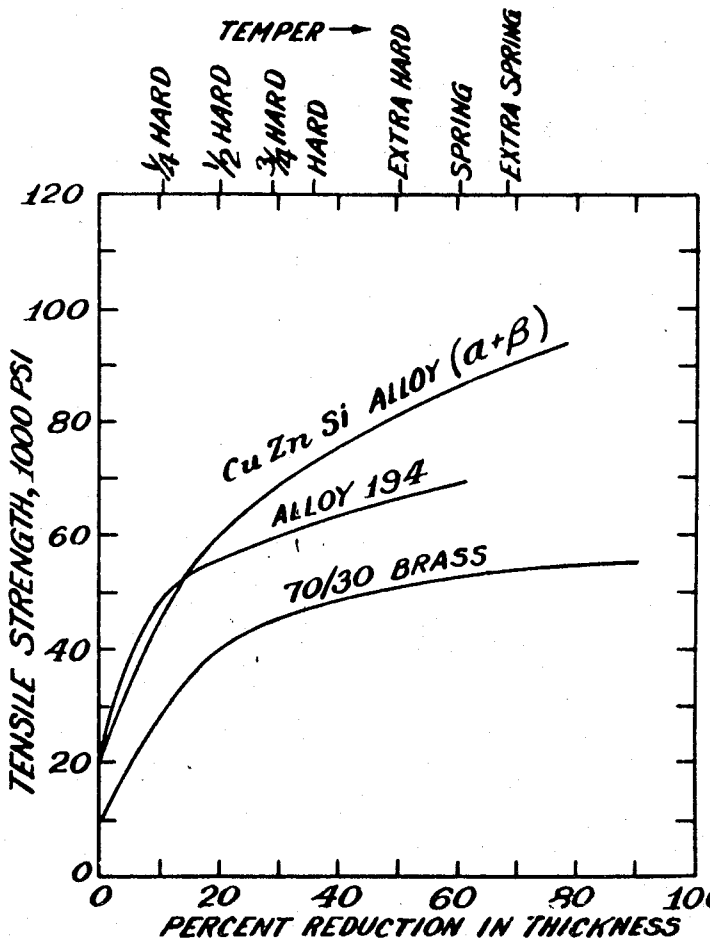
FIG. 12 illustrates the effect of cold rolling on yield stress.

FIG. 12 illustrates the marked increase in the yield strength of the $\alpha+\beta$ form of alloy made in comparison with 70/30 brass and Alloy 194.

Figure 14:
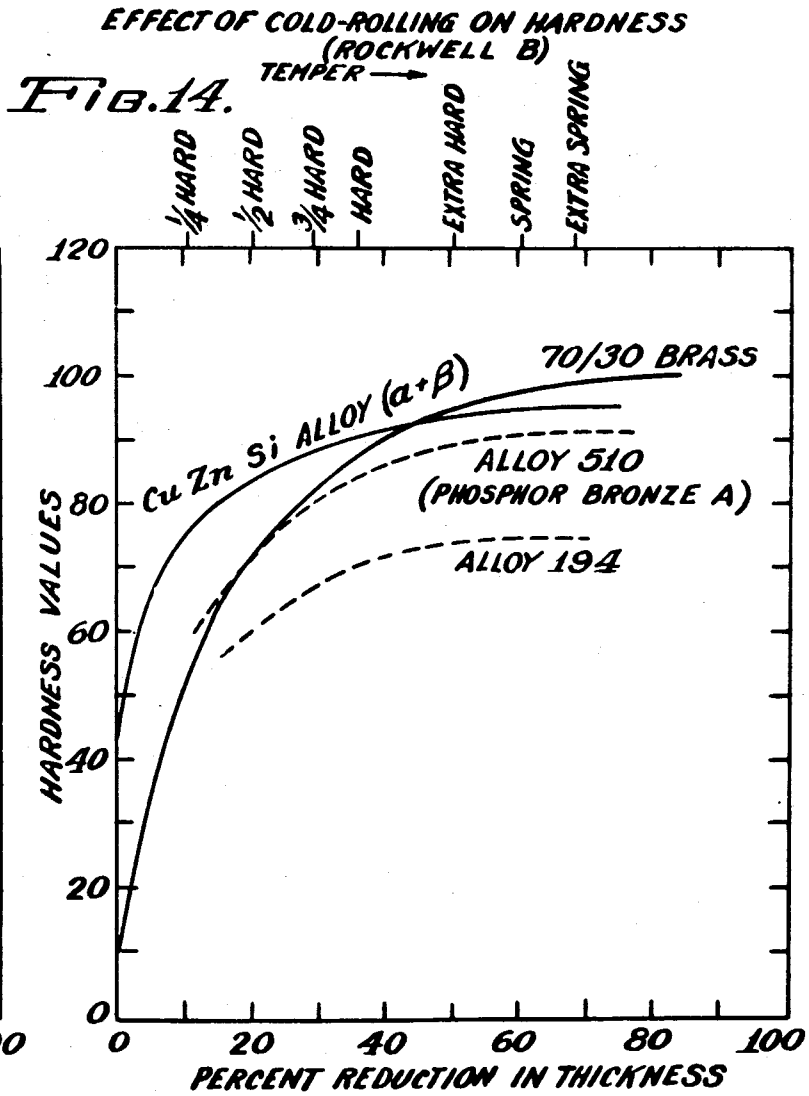
FIG. 14 illustrates the effect of cold rolling on the hardness.
Figure 13:
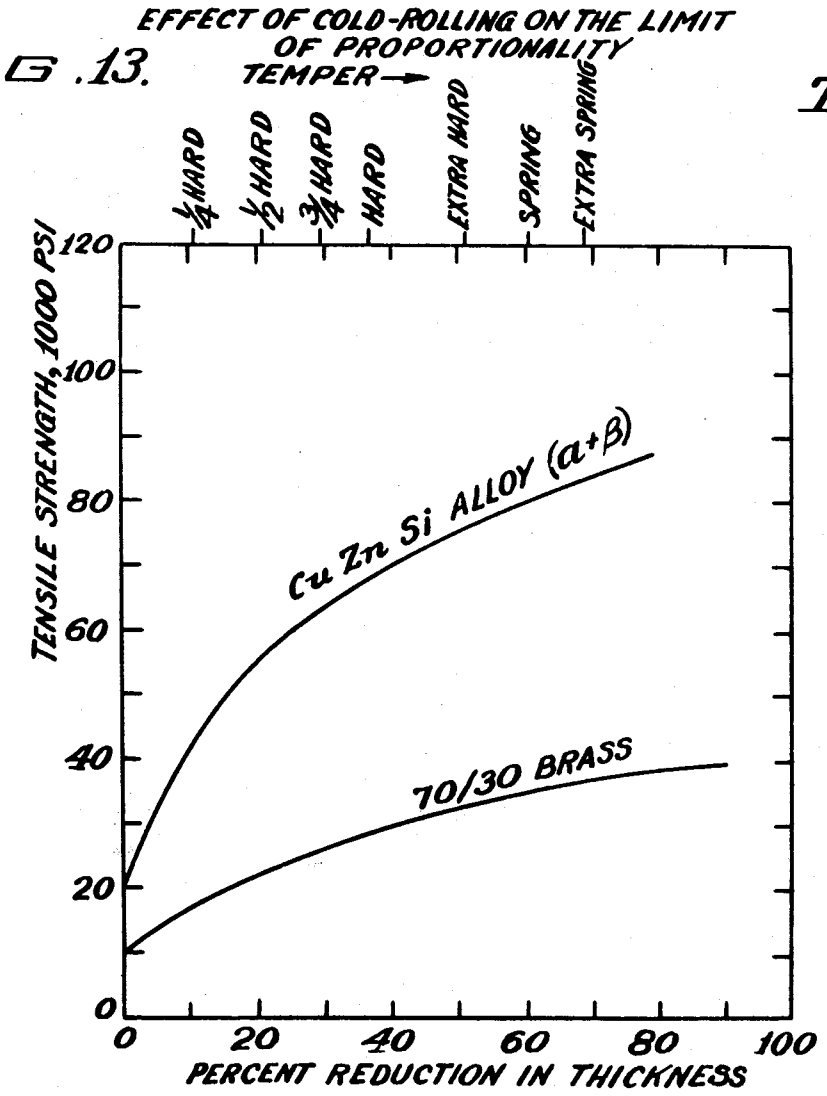
FIG. 13 illustrates the effect of cold rolling on the limit of proportionality.

FIG. 13 illustrates the effect of cold rolling on the limit of proportionality. That is, the material with a higher tensile strength as it is reduced in thickness by greater and greater amounts has a greater proportional limit than a material with a lower tensile strength. It can be seen that the alpha plus beta ($\alpha+\beta$) alloy exhibits a dramatic increase in the limit or proportionality over 70/30 brass. FIG. 14 illustrates the effect of cold rolling on hardness. It is desirable that the cold rolling make the material harder, however, not so hard that it would tend to become brittle. As can be seen by the diagram of FIG. 14, the ($\alpha+\beta$) alloy compares quite favorably with the prior art alloys used for similar purposes.

Figure 15:
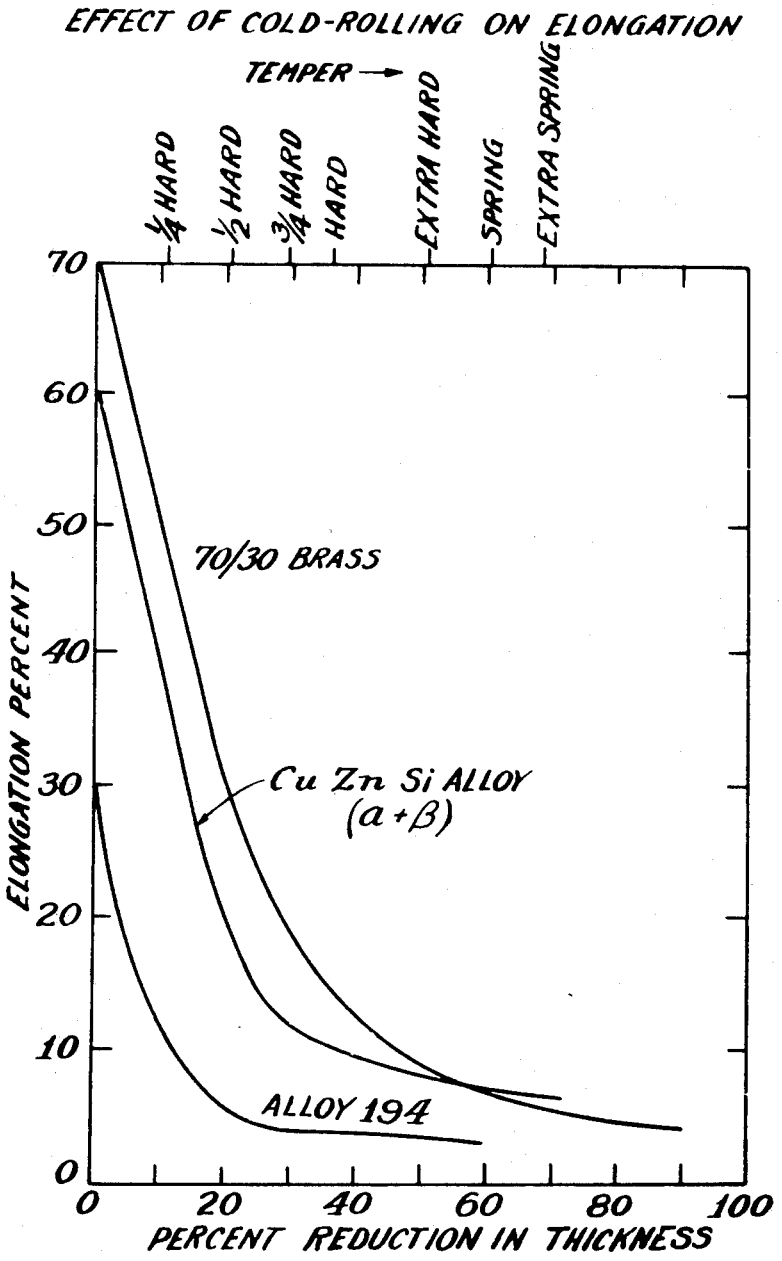
FIG. 15 illustrates the effect of cold rolling on elongation characteristics.

FIG. 15 illustrates the relationship between the amount of elongation which a material will exhibit or permit as a function of the amount of reduction in thickness of the material by cold rolling. In the range where the various materials are the strongest, namely, when the temper is designated as spring or extra spring, the silicon brass alloy exhibits elongation characteristics which are at least equal or superior to the prior art materials.

In Example 1 and Example 3, the material was a mixture of alpha phase and beta phases. In Example 1, the alpha phase constitutes approximately 60% of the material with the beta phase comprising the remaining 40%. It is possible, however, depending upon the composition and the Martensite transformation temperature to provide for an alloy having 50% plus or minus 20% alpha phase and 50% minus or plus 20% beta phase.

Figure 7:
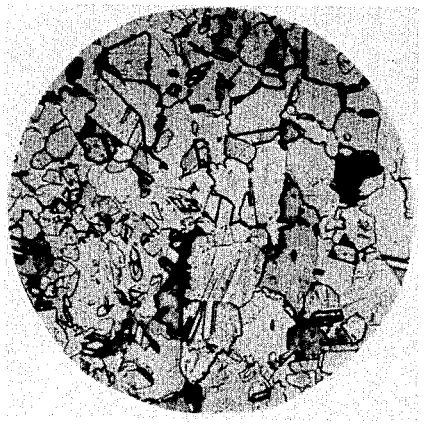
FIG. 7 is a photomicrograph illustrating the grain size and structure of the alpha plus beta phases of the copper-silicon-zinc composition taken at 40 magnifications.
Figure 8:
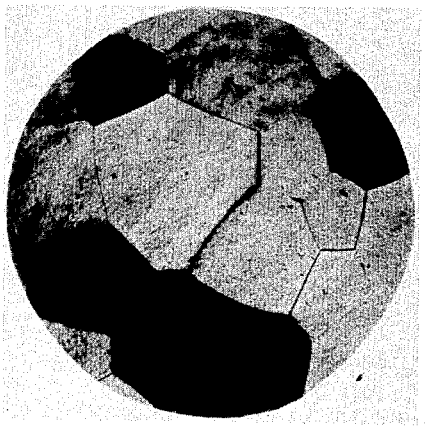
FIG. 8 is another photomicrograph of a copper silicon zince beta phase taken at 40 magnifications.

FIGS. 7 and 8 respectively are photomicrographs of the alpha plus beta of Example 1 and the beta phase material of Example 2. As seen by examination of FIG. 7, the alpha plus beta material has a fine grain size, whereas the pure beta phase material has a large grain size. In the following discussion, both the alpha plus beta and the beta phase materials will be discussed in regard to various physical properties. Also, it should be noted that the beta phase alloy will exhibit the super elastic, shape-memory and spring back properties discussed below even through small amounts of the alpha phase may be contained in the beta phase.

The beta brass alloy of Example 2 demonstrates an improved or low spring back coefficient exhibited. The spring back coefficient is somewhat related to the phenomena known as super elasticity, sometimes observed in various alloys. Super elasticity implies that a material will react in a "pseudo-elastic" and sometimes nonlinear fashion over a very long range of strains of that material. Generally, super elasticity is associated with cast materials or hot worked ingots as contrasted with strip, sheet, wire or other wrought materials. That is, it has been found that many materials which are super elastic cannot be easily made into sheet materials by means of cold rolling or other such similar forming operations.

It is thus desirable to provide a material which can be sheet formed and which will exhibit characteristics analogous to those observed in cast superelastic materials. Such a sheet material would also be one having a low spring back coefficient. While heretofore there has been no material which was super elastic and which also could be formed into a sheet material and thus have a low spring back coefficient, the described beta brass material has such unique properties. That is, the material can be rolled into plate and ultimately into sheet or drawn into thin rod or wire and will after betatization exhibit not only super elastic properties, but will exhibit an extremely low spring back coefficient. Since it has been impossible heretofore to form super elastic materials into a sheet or a drawn condition, it is remarkable that the beta brass alloy provides a material which exhibits properties even more desirable than simple super elastic properties.

As mentioned above, the means for comparing elastic properties of sheet or wire materials is known as the spring back coefficient. FIG. 16 illustrates the definition of this coefficient, K. Materials having a low spring back coefficient have the ability upon bending of returning substantially to their original condition. Thus, a material which is perfectly elastic and can return completely to its initial position will have a spring back coefficient of O. A material which will not return to its new position, but will remain at a position to which it is bent, will have a spring back coefficient of 1. Lead is a typical example of a material having a spring back coefficient of 1.

The coefficient, K, is mathematically defined as the ratio of the original angular deflection of a sheet of material from the horizontal compared with the final angle of deflection once the force imparting the deflection has been removed. For example, if the original deflection imparted over a mandrel having a radius of $R_O$ is equal to 90° and the final angle $\alpha_f$ is 45° after the material is released, then the spring back coefficient is 0.5.

Referring now to FIG. 17, there is shown a diagram wherein the spring back coefficient is plotted against the radius of a mandrel about which the spring or formed sheet is bent. As can be seen by examining the graph, the brass material described above has a drastically improved spring back coefficient. As illustrated in FIG. 17, the spring back coefficients for the $\beta$ and $\alpha+\beta$ brass alloys are significantly lower than competitive type materials utilized for the same purposes.

Another phenomenum observed in the present invention is often termed the "shape memory effect". That is, the beta brass alloy may be deformed at a temperature below the Martensite transformation temperature. Upon heating the alloy above the Martensite transformation temperature, the deformed alloy material will almost resume its original configuration. This has been found particularly true for the beta ($\beta$) embodiment (Example 2) described above. Moreover, if you again cool the material below the transformation temperature, but render no stress, the material will return to nearly the same shape as the original deformed material. Upon reheating, the material again returns to its original undeformed shape. Such cycling may be continued.

Other advantages exhibited by both the alpha plus beta and beta brass alloys include the good machinability, easy tinning and solderability and improved fatique resistance in comparison with prior art spring materials.

As set forth below in Table A, there is an indication of the electrical conductivity at 68° F. exhibited by both of the brass alloys of Examples 1 and 2 as compared with typical competitive alloys. The conductivity is well within the range of being acceptable, thus indicating utility of the invention for various electrical contactors, etc.

TABLE A

| ELECTRICAL CONDUCTIVITY % IACS AT 68° F | |
|---|---|
| CuZnSi Alloy $\beta \approx$ | 23% |
| CuZnSi Alloy $\alpha + \beta \approx$ | 22% |

TABLE A-continued

| ELECTRICAL CONDUCTIVITY % IACS AT 68° F | |
|---|---|
| Beryllium Copper 10 | before heat treatment 25%<br>after heat treatment 50% |
| 70/30 Brass $\approx$ | 28% |
| Alloy 194 $\approx$ | 60% |

Example 3 refers to the alpha plus beta embodiment of the invention. Typical tensile data of the new improved alpha plus beta alloy as processed in accordance with the new method IV to different tempers is presented in Table B.

TABLE B

TYPICAL MECHANICAL PROPERTIES OF COLD ROLLED STRIP, PROCESSED ACCORDING TO METHOD IV

| TEMPER | ULTIMATE TENSILE STRENGTH (psi) | YIELD STRENGTH 0.1% OFFSET (psi) | YIELD STRENGTH 0.2% OFFSET (psi) | ELONGATION IN 2" | ROCKWELL B HARDNESS |
|---|---|---|---|---|---|
| Annealed at 500° C. | 63,000 | 24,000 | 25,000 | 65 | 45 |
| ROLLED TEMPERS | | | | | |
| ¼ Hard | 76,000 | 60,000 | 63,000 | 32 | 78 |
| ½ Hard | 83,000 | 69,000 | 73,000 | 15 | 83 |
| ¾ Hard | 88,000 | 75,000 | 80,000 | 11 | 87 |
| Hard | 93,000 | 79,000 | 84,000 | 9 | 91 |
| Extra Hard | 101,000 | 85,000 | 91,000 | 7 | 93 |
| Spring | 108,000 | 90,000 | 95,000 | 6 | 95 |
| Extra Spring | 114,000 | 95,000 | 101,000 | 5 | 96 |

The improvement in properties resulting from low temperature annealing treatments (Method VI) prior to final rolling is presented in Table C. Comparison of both sets of data indicate that strength may be increased approximately 25% for the same amount of cold work.

TABLE C

EFFECT OF LOW TEMPERATURE ANNEALS ON MECHANICAL PROPERTIES OF COLD ROLLED STRIP - METHOD VI

| TEMPER | ULTIMATE TENSILE STRENGTH (psi) | YIELD STRENGTH 0.1% OFFSET (psi) | YIELD STRENGTH 0.2% OFFSET (psi) | ELONGATION IN 2" | ROCKWELL B HARDNESS |
|---|---|---|---|---|---|
| Annealed 4 hrs. at 300° C. | 82,000 | 55,000 | 58,000 | 45 | 75 |
| ROLLED TEMPER | | | | | |
| ¼ Hard | 93,000 | 83,000 | 86,000 | 16 | 86 |
| ½ Hard | 102,000 | 86,000 | 94,000 | 11 | 90 |
| ¾ Hard | 108,000 | 95,000 | 100,000 | 8 | 93 |
| Hard | 112,000 | 96,000 | 103,000 | 8 | 94 |
| Extra Hard | 115,000 | 102,000 | 108,000 | 7 | 95 |
| Annealed 22 hrs. at 300° C. | 78,000 | 49,000 | 51,000 | 53 | 70 |
| ROLLED TEMPER | | | | | |
| ¼ Hard | 90,000 | 71,000 | 76,000 | 28 | 83 |
| ½ Hard | 98,000 | 85,000 | 86,000 | 14 | 88 |
| ¾ Hard | 104,000 | 86,000 | 93,000 | 9 | 91 |
| Hard | 108,000 | 97,000 | 97,000 | 8 | 92 |
| Extra Hard | 112,000 | 98,000 | 104,000 | 7 | 95 |

As was pointed out earlier in the description of Method V (Example 3), a low temperature partial anneal carried out at the final strip thickness could bring about a substantial improvement in engineering properties. This is illustrated in Table D. Notable improvements are higher fatique strength, and greater elongation. Since yield strength has been reduced without sacrificing ultimate tensile strength, better formability is achieved.

TABLE D

MECHANICAL PROPERTIES OF ANNEALED TO TEMPER STRIP PROCESSED ACCORDING TO METHOD V TENSILE PROPERTIES

| CONDITION | ULTIMATE TENSILE STRENGTH (psi) | .2% YIELD STRENGTH (psi) | % ELON-GATION | FATIGUE STRENGTH AT 100 MILLION CYCLES (psi) |
|---|---|---|---|---|
| Rolled to ¾ Hard Temper | 88,000 | 78,000 | 14 | 31,000 |
| Annealed to Comparable Temper | 86,000 | 62,000 | 42 | 38,000 |

Figure 24:
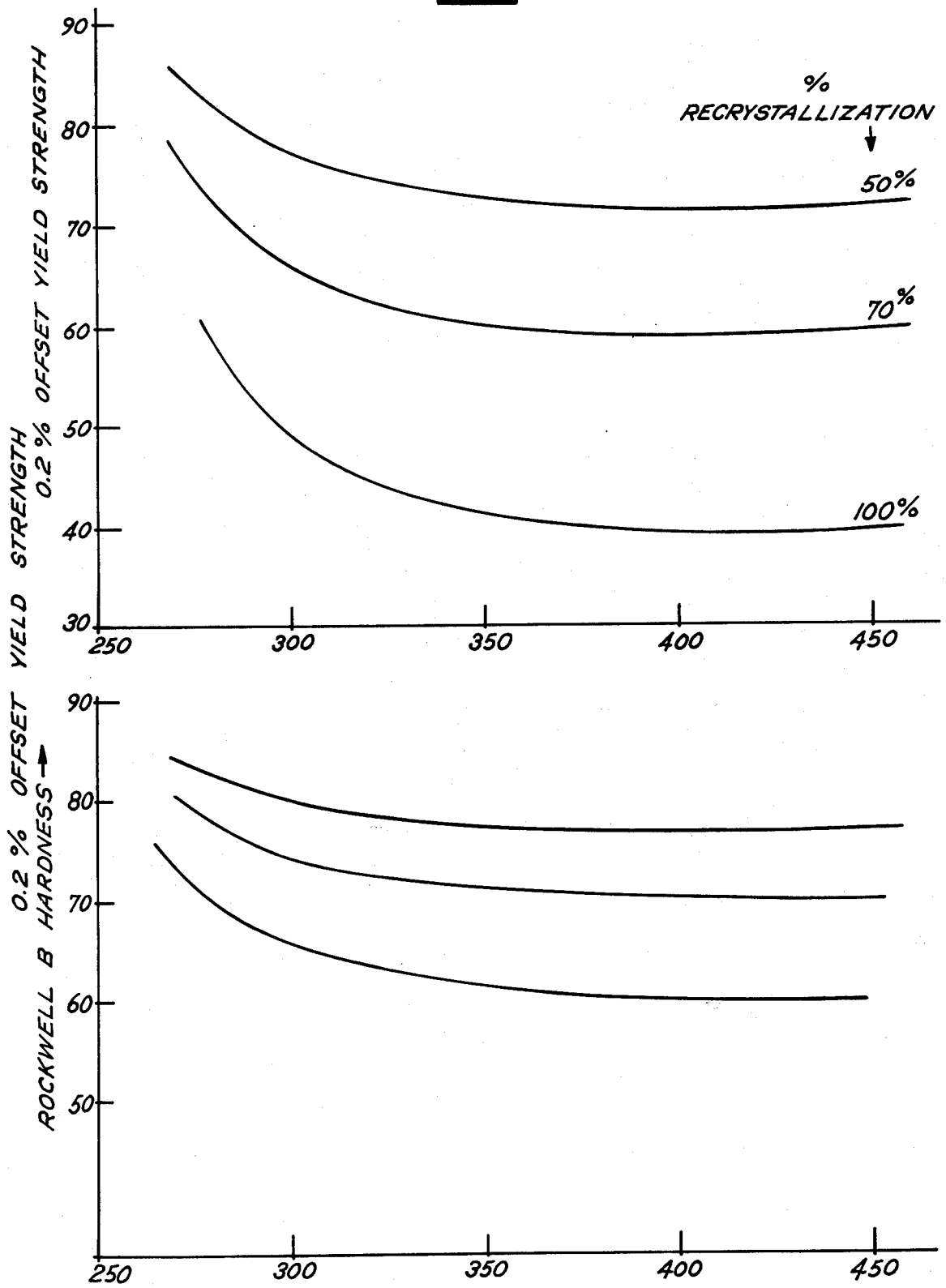
FIG. 24 is a pair of graphs comparing variation of yield strength and hardness with annealing temperature for constant states of annealing.
Figure 25:
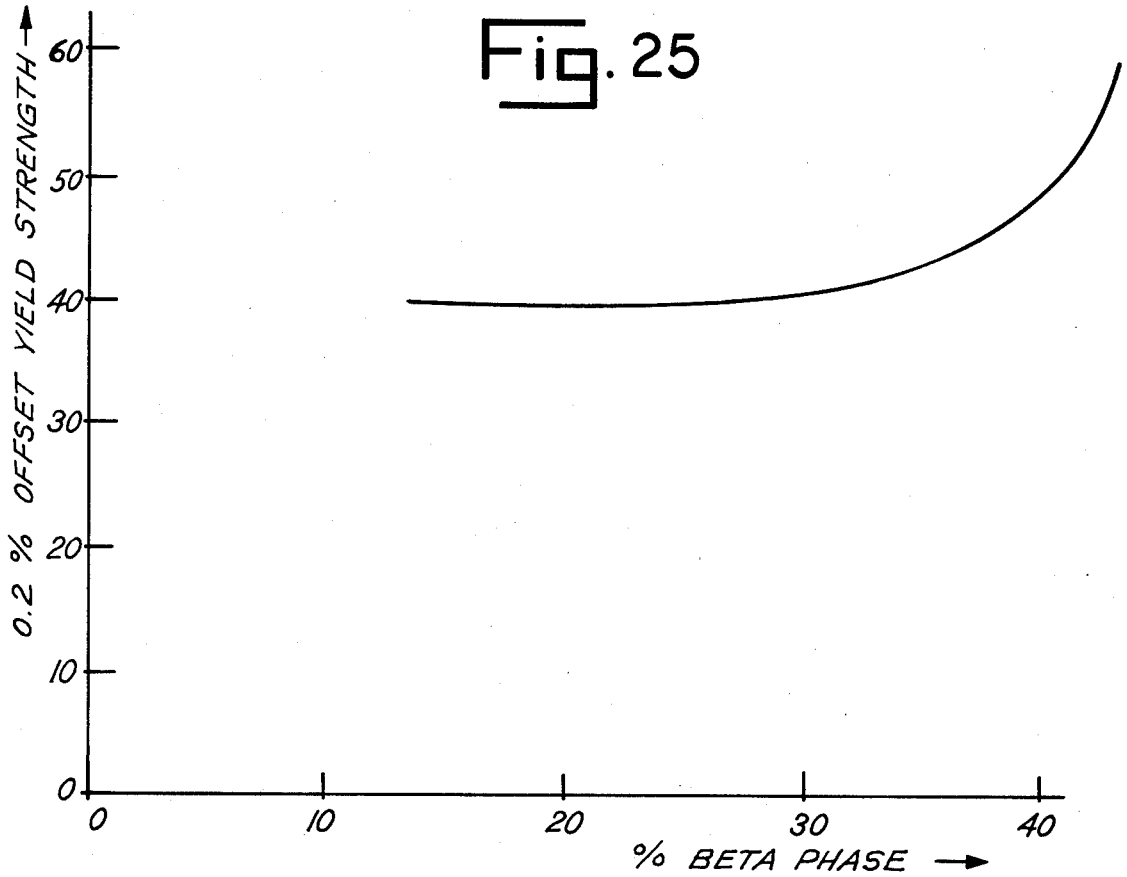
FIG. 25 is a graph of the variation of yield strength with volume fraction of $\beta$.

The fact that beneficial effects are produced at annealing temperatures less than 300° C. is proven once again in FIG. 24. Since the data for hardness and tensile strength were obtained at constant values of fractional annealing, the increase in strength (see FIG. 25) is not attributed to differences in residual deformation. Instead, it is due to precipitation of very fine dispersoids of the $\beta$ phase.

In summary, it has been shown that annealing at temperatures between 250° and 300° C. induces precipitation of $\beta$ simultaneously with recrystallization, thereby leading to an improvement in properties.

Another characteristic of the alloy that can be used to considerable advantage is its isotropic behavior. As may be seen from Table E, tensile properties do not vary appreciably with rolling direction. Thus, parts that are difficult to form may be oriented in the "bad" direction (perpendicular to the direction of rolling), resulting in less scrap, and better utilization of the strip.

TABLE E

ISOTROPIC TENSILE PROPERTIES OF THE ALLOY OF EXAMPLE 3

| | PARALLEL TO ROLLING DIRECTION | | | PERPENDICULAR TO ROLLING DIRECTION | | |
|---|---|---|---|---|---|---|
| TEMPER | ULTIMATE TENSILE STRENGTH (psi) | 0.2% YIELD STRENGTH (psi) | % ELON-GATION | ULTIMATE TENSILE STRENGTH (psi) | 0.2% YIELD STRENGTH (psi) | % ELON-GATION |
| Annealed | 63,000 | 25,000 | 65 | 61,000 | 24,000 | 61 |
| ¼ Hard | 76,000 | 63,000 | 32 | 75,000 | 56,000 | 26 |
| ½ Hard | 83,000 | 73,000 | 15 | 83,000 | 67,000 | 15 |
| ¾ Hard | 88,000 | 80,000 | 11 | 90,000 | 73,000 | 12 |
| Hard | 93,000 | 84,000 | 9 | 96,000 | 78,000 | 10 |
| Extra Hard | 101,000 | 91,000 | 7 | 106,000 | 87,000 | 8 |
| Spring | 108,000 | 95,000 | 6 | 114,000 | 93,000 | 7 |
| Extra Spring | 114,000 | 101,000 | 5 | 121,000 | 101,000 | 6 |

One of the most desirable features of the alloy is its springiness. The superior spring properties compared with commercial copper based alloys of comparable strength are shown in FIG. 17. Data for this graph was obtained by bending strips of material over mandrels of different radii and measuring the amount of springback when the bending force was removed as previously described.

Another outstanding feature of the ternary alloy is its high cycle fatique strength, as indicated in Table F. The fatigue strength at 100 million cycles in the low temperature anneal condition is 38,000 psi. This stress is higher than any known copper based alloy having comparable tensile strength (86,000 psi).

TABLE F

FATIGUE STRENGTH OF NEW ALLOY AT DIFFERENT STRENGTH LEVELS

| TEMPER | ULTIMATE TENSILE STRENGTH (psi) | FATIGUE STRENGTH AT 100 MILLION CYCLES (psi) |
|---|---|---|
| ¾ Hard (annealed to temper) | 86,000 | 38,000 |
| Extra Hard | 99,000 | 34,000 |
| Extra Spring | | |
| Good Direction | 112,000 | 38,000 |
| Bad Direction | 120,000 | 38,000 |

COMPARISON WITH OTHER COPPER ALLOYS

Binary Cu-Zn System

Figure 26:
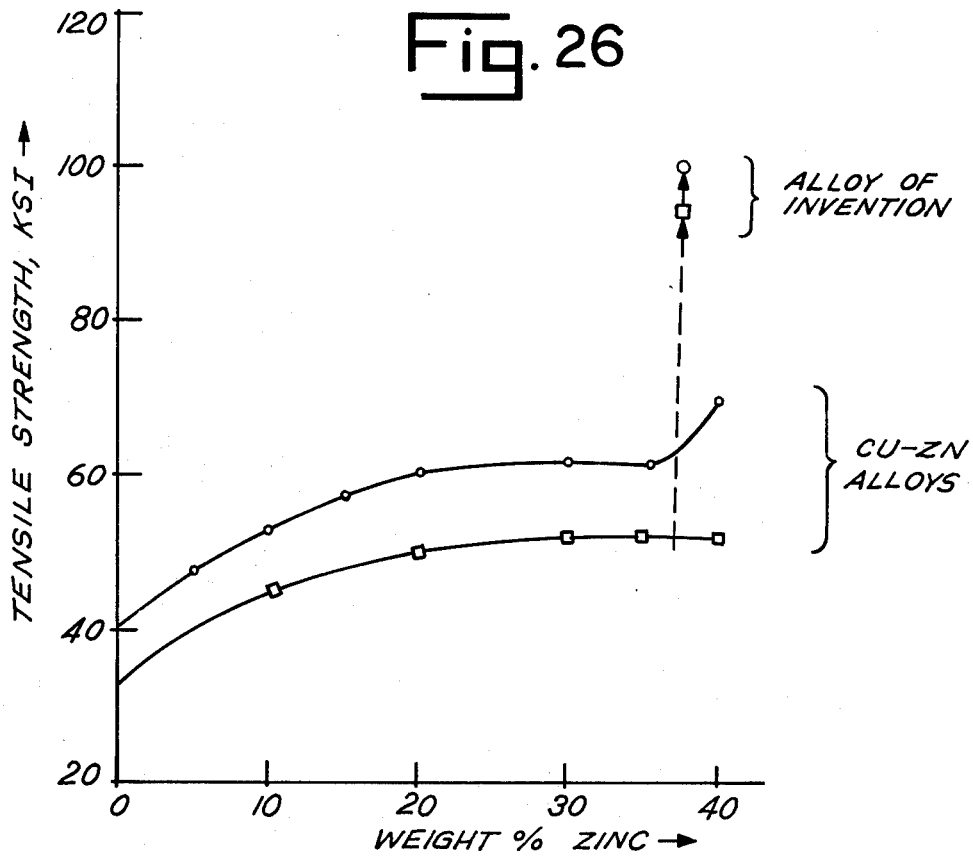
FIG. 26 is a graph of the effect of zinc content upon ultimate tensile strength and 0.5% yield strength; ½ hard temper.

FIG. 26 shows the various of tensile strength with zinc content for single phase $\alpha$ and duplex $\alpha+\beta$ alloys (from the Metals Handbook). Included in this graph is data for a 62.2 Cu − 37.4 Zn alloy containing 0.4 wt. % Si, which had been processed according to Method III. As can be seen, this small amount of Si increases the ultimate tensile and 0.5% yield strength nearly 75% compared with the binary Cu−Zn alloys. In other words, the causation from silicon is not additive, but synergistic.

Ternary Cu-Zn-Si Alloys

A number of different alloys were cast into slabs, cold rolled to strip and tested for mechanical properties. A summary of some findings is presented in Table G.

TABLE G

ASSESSMENT OF FABRICABILITY AND STRENGTH FOR DIFFERENT ALLOY COMPOSITIONS

| ALLOY NO. | NOMINAL COMPOSITION, WT. % | | | CHARACTERISTICS |
|---|---|---|---|---|
| | Cu | Zn | Si | |
| A | 64.56 | 35 | 0.44 | Cold rolls easily, low |

TABLE G-continued

ASSESSMENT OF FABRICABILITY AND STRENGTH FOR DIFFERENT ALLOY COMPOSITIONS

| ALLOY NO. | NOMINAL COMPOSITION, WT. % | | | CHARACTERISTICS |
|---|---|---|---|---|
| | | | | tensile strength |
| B | 61.56 | 38 | 0.44 | Good strength, rolls easily |
| C | 59.56 | 40 | 0.44 | Extensive cracks, needs to be hot worked |
| D | 62.12 | 37.4 | 0.44 | Cold rolls easily, good properties |
| E | 66.5 | 31.25 | 2.25 | Extensive cracks |
| F | 69.56 | 30 | 0.44 | Rolls easily, low Strength |

Figure 27:
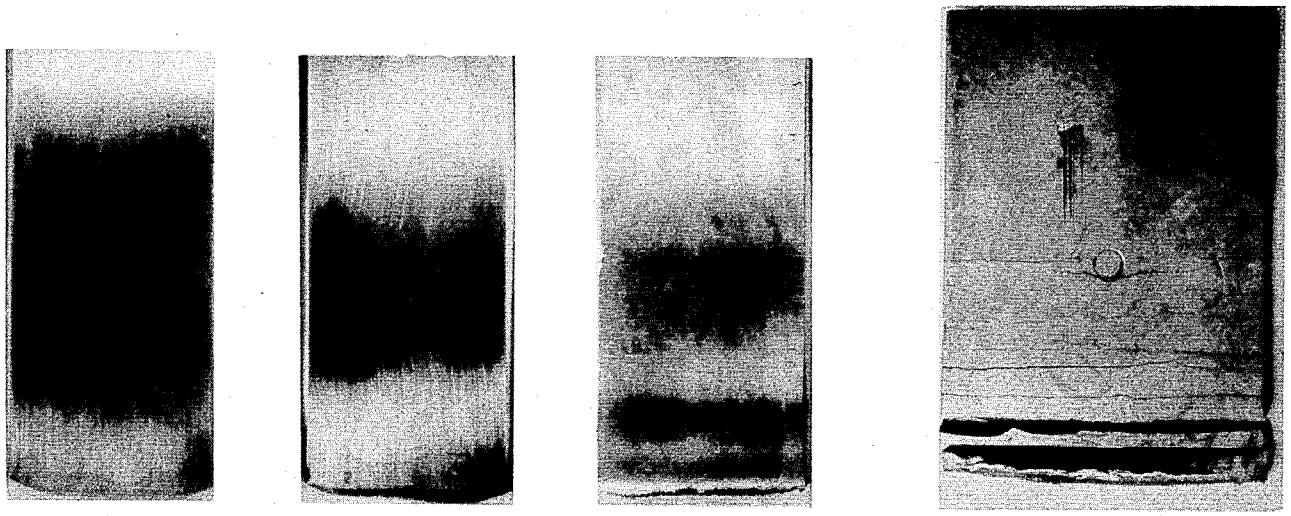
FIG. 27 is a series of photomicrographs showing cracks formed by cold rolling high zinc and high silicon alloys.

For low Si contents (0.44%) extensive cracks formed during rolling (at about 10% reduction) in the high Zn content alloy (40%). Presumably, the sinc rich $\beta$ phase does not withstand plastic deformation as well as the structurally analogous copper rich $\beta$ phase. Metallographic examination of alloy No. C revealed a continuous $\beta$ phase matrix, which contributes to poor formability. An example of such cracks is shown in FIG. 27. Although the low Zn – low Si content alloy (No. A) could be cold rolled easily, its mechanical properties were poorer than that of the alloy of the invention.

Fabrication of the high Si content alloy (No. E) by cold rolling also proved extremely difficult, and extensive cracks formed throughout the ingot. In fact, this alloy broke into numerous pieces for standard amounts of cold reduction. The reason why high Si - low Zn content alloys display such poor fabricability becomes apparent upon inspection of the Cu–Zn–Si phase diagram (see FIGS. 1 through 4). At temperatures less than 550° C., the extremely brittle $\gamma$ phase becomes stable and precipitates throughout the matrix. It is known that formation of $\gamma$ in copper based alloys can cause embrittlement.

COMMERCIAL HIGH STRENGTH COPPER BASED ALLOYS

As shown previously in FIG. 17, the present alloy has superior spring properties compared with other commercial high performance copper based alloys. In a similar comparison, fatigue properties of the alloy are outstanding. Table H is a summary of fatigue test results for eight different alloys, each tested in sheet form by symmetrical reverse bending. The unusually high strength of the present alloy at 100 million cycles is a result of improved ternary brass alloy and its fabrication process.

TABLE H

COMPARISON OF FATIGUE PROPERTIES OF THE NEW ALLOY WITH OTHER COMMERCIAL COPPER BASED ALLOYS

| ALLOY | CDA NO. | TEMPER | FATIGUE STRENGTH AT 100 MILLION CYCLES (psi) |
|---|---|---|---|
| HSM Copper | 194 | Hard | 21,000 |
| | | Spring | 21,500 |
| Cartridge Brass | 260 | Hard | 24,000 |
| | | Spring | 25,000 |
| | | Extra Spring | 27,000 |
| Phosphor Bronze, A | 510 | Hard | 26,000 |
| | | Spring | 28,000 |
| Spring Bronze | 434 | Hard | 24,000 |
| | | Spring | 26,000 |
| Nickel Silver | 735 | Hard | 26,000 |
| | | Spring | 29,000 |
| Alcoloy | 688 | Extra Spring | 32,500 |
| Lubaloy X | 425 | Extra Hard | 29,000 |
| | | Super Spring | 30,500 |
| New Alloy | | Extra Hard | 34,000 |

TABLE H-continued

COMPARISON OF FATIGUE PROPERTIES OF THE NEW ALLOY WITH OTHER COMMERCIAL COPPER BASED ALLOYS

| ALLOY | CDA NO. | TEMPER | FATIGUE STRENGTH AT 100 MILLION CYCLES (psi) |
|---|---|---|---|
| | | Extra Spring | 38,000 |

While in the foregoing there has been presented a preferred embodiment of the invention, it is to be understood that the invention shall be limited only by the following claims and their equivalents.

What is claimed is:

1. A method for making an improved ternary brass alloy that includes silicon as an additive material comprising the steps of:

preparing a substantially homogeneous, polycrystalline mix of 25% to 40% by weight zinc, 0.25% to 3.0% by weight silicon and the balance copper;

alternately cold rolling and intermediate annealing said alloy;

said annealing being in the range of 400° C. to 550° C. to soften said alloy and produce a continuous matrix of alpha phase material with uniformly distributed beta phase material including a minimum of about 25% beta phase material and a maximum of about 75% alpha phase material during said anneal.

2. A method of making an improved ternary brass alloy that includes silicon as an additive material comprising the steps of:

preparing a substantially homogeneous polycrystalline mix of 25% to 40% by weight zinc; 0.25 to 3.0% by weight silicon and the balance copper;

alternately cold rolling and intermediate annealing said alloy;

and finally annealing said alloy in the range of 250° C. to 300° C. for at least four hours.

3. The improved method of claim 2 plus a final working step of rolling and reducing said alloy by at least 10%.

4. The improved method of claim 2 including the final step of reducing said alloy by working, said reduction being in the range of 10% to 50%.

5. A method of making an improved ternary brass alloy that includes silicon as an additive material comprising the steps of:

preparing a substantially homogeneous polycrystalline mix of 25% to 40% by weight zinc; 0.25 to 3.0% by weight silicon and the balance copper;

alternately cold rolling and intermediate annealing said alloy;

said annealing being in the range of 400° C. to 550° C. to soften said alloy and produce a continuous matrix of alpha phase material with uniformly distributed beta phase material including a minimum of about 25% beta phase material and a maximum of about 75% alpha phase material during said anneal;

and finally annealing said alloy in the range of 250° C. to 300° C. for at least 4 hours.

6. A method of making an improved ternary brass alloy that includes silicon as an additive material comprising the steps of:

preparing a substantially homogeneous polycrystalline mix of 25% to 40% by weight zinc, 0.25 to 3.0% by weight silicon and the balance copper;

alternately cold rolling and annealing said alloy;

said annealing steps initially above about 400° C. and providing about 25% $\beta$ phase dispersed uniformly in an $\alpha$ phase matrix and subsequently providing increased $\beta$ phase by annealing at temperatures less than 400° C. to increase the amount of $\beta$ phase to about 50%.

* * * * *